US005534394A

United States Patent [19]

Ishikawa et al.

[11] Patent Number: 5,534,394

[45] Date of Patent: Jul. 9, 1996

[54] METHOD FOR PROCESSING SILVER HALIDE COLOR PHOTOGRAPHIC MATERIALS

[75] Inventors: Takatoshi Ishikawa; Shinji Ueda; Hirotomo Sasaki; Tetsuro Kojima, all of Kanagawa, Japan

[73] Assignee: Fuji Photo Film Co., Ltd., Kanagawa, Japan

[21] Appl. No.: 331,876

[22] Filed: Nov. 1, 1994

Related U.S. Application Data

[63] Continuation of Ser. No. 41,897, Apr. 2, 1993, abandoned, which is a continuation of Ser. No. 630,616, Dec. 20, 1990, abandoned.

[30] Foreign Application Priority Data

Dec. 21, 1989 [JP] Japan ..... 1-332148

[51] Int. Cl.[6] ..... G03C 7/42

[52] U.S. Cl. ..... 430/393; 430/430; 430/460; 430/461

[58] Field of Search ..... 430/357, 393, 430/430, 434, 460, 461

[56] References Cited

U.S. PATENT DOCUMENTS

| | | | |
|---|---|---|---|
| 3,843,367 | 10/1974 | Schranz et al. | 430/393 |
| 3,879,202 | 4/1975 | Yamaguchi | 430/372 |
| 4,033,771 | 7/1977 | Borton et al. | 430/460 |
| 4,801,516 | 1/1989 | Ishikawa et al. | 430/380 |
| 4,801,521 | 1/1989 | Ohki et al. | 430/380 |
| 4,853,318 | 8/1989 | Fujita et al. | 430/380 |
| 4,876,174 | 10/1989 | Ishikawa et al. | 430/380 |
| 4,908,300 | 3/1990 | Koboshi et al. | 430/393 |
| 4,939,075 | 7/1990 | Bergthaller et al. | 430/460 |
| 4,983,503 | 1/1991 | Ishikawa et al. | 430/460 |
| 4,985,347 | 1/1991 | Fujimoto et al. | 430/393 |

FOREIGN PATENT DOCUMENTS

| | | | |
|---|---|---|---|
| 0306293 | 3/1989 | European Pat. Off. . | |
| 0325277 | 7/1989 | European Pat. Off. . | |
| 3095451 | 4/1988 | Japan | 430/460 |
| 0385628 | 4/1988 | Japan | 430/460 |
| 64-62642 | 3/1989 | Japan . | |
| 1190855 | 5/1970 | United Kingdom . | |

OTHER PUBLICATIONS

Patent Abstracts of Japan, vol. 4, No. 163, Aug. 1980.

*Primary Examiner*—Hoa Van Le
*Attorney, Agent, or Firm*—Sughrue, Mion, Zinn, Macpeak & Seas

[57] ABSTRACT

A method for processing a silver halide color photographic material with which edge staining and the occurrence of staining on aging after processing can be prevented, and with which the stability of the bleach-fixer can be improved, comprising color developing and bleach-fixing the photographic material, wherein the bleach-fixer contains (1) thiosulfate, (2) at least one type of compound selected from among the group of compounds represented by formulae (I) and (II):

(I)

(II)

wherein Ra, Rb, $R^1$ through $R^4$, $X^1$ and n are as defined in the specification, and (3) an adduct of bisulfite with at least one type of compound selected from among the group of compounds represented by formulae (A), (B), (C) and (D):

(A)

(B)

(C)

(D)

wherein $R_1$ through $R_{11}$, X, Y, Z, m and n are as defined in the specification.

12 Claims, No Drawings

METHOD FOR PROCESSING SILVER HALIDE COLOR PHOTOGRAPHIC MATERIALS

This is a Continuation of application Ser. No. 08/041,897 filed on Apr. 2, 1993, now abandoned, which is a continuation of application Ser. No. 07/630,616 filed on Dec. 20,1990, abandoned.

FIELD OF THE INVENTION

This invention concerns a method for processing silver halide color photographic materials, and in particular it concerns a method for processing in which the stability of the bleach-fixer is increased and in which there is a marked improvement in respect of the permeation of liquid into the cut parts of the photographic material during processing (edge permeation) and in respect of the increase in density of the non-colored parts after processing (staining).

BACKGROUND OF THE INVENTION

In earlier times, bleaching and fixing processes were generally carried out after color development in color development processing but processing with a bleach-fix bath in which bleaching and fixing are accomplished in a single bath is now widely used, especially for print materials, with a view to simplifying processing, economizing on processing baths and rapid processing. However, when the thiosulfates generally used as fixing agents are present along with various oxidizing agents as typified by the aminopolycarboxylic acid iron complexes they are oxidized, sulfur is liberated (vulcanization) and there is a disadvantage in that undesirable material is liable to become attached to the color printing paper and in that color staining is liable to occur. Sulfite ion is generally used as a stabilizing agent to ameliorate these disadvantages but the effect obtained is inadequate. Furthermore, techniques in which aldehyde/bisulfite adducts are used have been proposed in West German Patent Application (OLS) 2,102,713, JP-A-50-51326 and JP-A-48-42733 (the term "JP-A" as used herein means an "unexamined published Japanese patent application"). The stability of the bleach-fixer is improved by these techniques and the sulfiding time is increased. However, there is a major disadvantage in that there is increased staining of the processed photographic material on ageing. Moreover, during continuous processing the processing liquids (and especially the bleach-fixer components) permeate to a distance of some 0.5 to 1 mm from both of the cut edges of the photographic material, i.e., so-called edge permeation which results in a yellow coloration and this is a serious problem, especially in the case of print materials. It is thought that this is because the free sulfite ion concentration in the bleach-fixer is so low that degradation and washing out of the developing agent by the bleach-fixer is inadequate with the result that staining and edge permeation occurs readily. In rapid processing, where the processing time for the bleach-fix and following processes is not more than 3 minutes, these problems are even more pronounced because the washing out of developer and bleach-fixer components is then even more inadequate.

On the other hand, compounds of formulae (I) and (II) shown below have been disclosed as preservatives for color development baths in, for example, WO87/05434, WO87/06026 and U.S. Pat. Nos. 4,801,516 and 4,801,521. A technique for improving aging stability by adding these compounds to thiosulfate containing liquids such as stabilizers for example has been disclosed in JP-A-63-85628. However, a satisfactory effect has not been obtained on applying this technique to bleach-fixers, which have a high concentration of bleaching agent.

SUMMARY OF THE INVENTION

Hence, the aim of the present invention is to provide a method for processing silver halide color photographic materials with which edge staining and the occurrence of staining on aging after processing can be prevented. Moreover, the present invention is intended to improve the stability of the bleach-fixer in particular.

It has been discovered that the above mentioned aims can be realized effectively by means of the technique described below.

That is, the present invention relates to a method for processing a silver halide color photographic material comprising color developing and bleach-fixing said photographic material, wherein said bleach-fixer contains (1) thiosulfate, (2) at least one type of compound selected from among the group of compounds represented by formulae (I) and (II) indicated below, and (3) an adduct of bisulfite with at least one type of compound selected from among the group of compounds represented by formulae (A), (B), (C) and (D) indicated below:

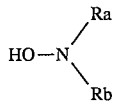

(I)

wherein Ra and Rb each independently represents a hydrogen atom, an alkyl group, an alkenyl group, an aryl group or a heterocyclic group, provided that Ra and Rb are not both at the same time hydrogen atoms;

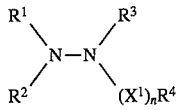

(II)

wherein $R^1$, $R^2$ and $R^3$ each independently represents a hydrogen atom, an alkyl group, an aryl group or a heterocyclic group, $R^4$ represents a hydrogen atom, a hydroxyl group, a hydrazino group, an alkyl group, an aryl group, a heterocyclic group, an alkoxy group, an aryloxy group, a carbamoyl group or an amino group, $R^1$ and $R^2$ or $R^3$ and $R^4$ may be combined to form a heterocyclic ring, $X^1$ represents a divalent group, and n represents 0 or 1, provided that when n is 0, $R^4$ represents an alkyl group, an aryl group or a heterocyclic group;

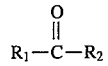

(A)

wherein $R_1$ represents a hydrogen atom, an alkyl group, an alkenyl group, an aralkyl group, a cycloalkyl group, an aryl group, a heterocyclic group, an ester group, an acyl group, a carbamoyl group, or a carboxylic acid group or a salt thereof and $R_2$ represents a hydrogen atom, an alkyl group, an alkenyl group, an aralkyl group, a cycloalkyl group, an aryl group or a heterocyclic group, and $R_1$ and $R_2$ may be combined to form a ring, provided that $R_1$ and $R_2$ are not both at the same time hydrogen atoms;

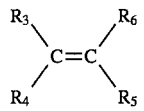

(B)

wherein $R_3$, $R_4$ and $R_5$ each independently represents a hydrogen atom, an alkyl group, an alkenyl group, an aralkyl group, a cycloalkyl group, an aryl group, a heterocyclic group, a carboxylic acid group, an ester group, an acyl group, a halogen atom, an ether group, sulfo groups or salts thereof, a sulfinyl group, a sulfonyl group, a cyano group, a nitro group, a carbamoyl group or a sulfamoyl group, and $R_6$ represents an electron attractive group, and $R_3$ and $R_4$, $R_4$ and $R_5$, $R_5$ and $R_6$, and $R_6$ and $R_3$ may be combined to form rings;

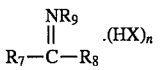

(C)

wherein $R_7$, $R_8$and $R_9$ each independently represents a hydrogen atom, an alkyl group, an alkenyl group, a cycloalkyl group, an aralkyl group, an aryl group, a heterocyclic group, an amino group, a carboxylic acid group, an ester group, an acyl group, an ether group, a hydroxyl group or a thioether group, X represents an anion, and n represents 0 or 1, and $R_7$ and $R_8$, $R_8$ $R_9$, and $R_9$ and $R_7$ may be combined to form rings;

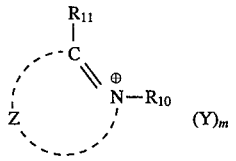

(D)

wherein $R_{10}$ represents an alkyl group, an alkenyl group, a aralkyl group, a cycloalkyl group, an aryl group, a heterocyclic group or a hydrogen atom, $R_{11}$ represents an alkyl group, an alkenyl group, an aralkyl group, a cycloalkyl group, an aryl group, a heterocyclic group, a hydrogen atom, a halogen group, an ether group, a carboxyl group, an acyl group, a cyano group, a sulfo group, a carbamoyl group, a nitro group, a dialkylamino group or an ester group, Z represents a heterocyclic ring comprised of carbon atoms, nitrogen atoms, oxygen atoms, sulfur atoms or selenium atoms, Y represents an anion, m represents 0 or 1, and $R_{10}$ can be bonded to an atom in Z to form a ring.

In this present invention, the aims can be realized with the conjoint use of compounds represented by formula (I) or (II) and compounds selected from among those represented by formulae (A), (B), (C) and (D), and such a conjoint use is in no way analogous to the conventional techniques.

Furthermore, it is thought that the fact that it is possible to maintain a low sulfite ion concentration (e.g., 0,004M or less, preferably 0.002M or less) by using the aforementioned adducts or the compounds which are used to form them in a bleach-fixer is one of the factors behind the aforementioned effect, but the detailed mechanism awaits clarification.

The sulfite ion concentration in the bleach-fixer of the present invention is $1\times10^{-6}$ to 0.05 mol/l, preferably $1\times10^{-5}$ to 0.02 mol/l, and more preferably $1\times10^{-5}$ to 0.01 mol/l.

Formula (I) is described in detail below.

Ra and Rb in formula (I) each independently represent a hydrogen atom, an unsubstituted or substituted alkyl group, an unsubstituted or substituted alkenyl group, an unsubstituted or substituted aryl group or an unsubstituted or substituted heterocyclic group, and Ra and Rb may be joined together and, together with the nitrogen atom, form a heterocyclic ring. However Ra and Rb cannot both at the same time be hydrogen atoms.

The alkyl groups and alkenyl groups represented by Ra and Rb may be linear chain, branched chain or cyclic groups. Substituent groups for the alkyl groups, alkenyl groups and aryl groups represented by Ra and Rb include halogen atoms (for example F, Cl, Br), aryl groups (for example, phenyl, p-chlorophenyl), alkyl groups (for example, methyl, ethyl, iso-propyl), alkoxy groups (for example, methoxy, ethoxy, methoxyethoxy), aryloxy groups (for example, phenoxy), sulfonyl groups (for example, methanesulfonyl, p-toluenesulfonyl), sulfonamido groups (for example, methanesulfonamido, benzenesulfonamido), sulfamoyl groups (for example, diethylsulfamoyl, unsubstituted sulfamoyl), carbamoyl groups (for example, unsubstituted carbamoyl, diethylcarbamoyl), amido groups (for example, acetamido, benzamido, naphthamido), ureido groups (for example, methylureido, phenylureido), alkoxycarbonylamino groups (for example, methoxycarbonylamino), aryloxycarbonylamino groups (for example, phenoxycarbonylamino), alkoxycarbonyl groups (for example, methoxycarbonyl), aryloxycarbonyl groups (for example, phenoxycarbonyl), cyano group, hydroxyl group, carboxyl group, sulfo group, nitro group, amino groups (for example, unsubstituted amino, diethylamino), alkylthio groups (for example, methylthio), arylthio groups (for example, phenylthio), hydroxyamino group and heterocyclic groups (for example, morpholyl, pyridyl). Here, Ra and Rb may be the same or different, and the substituent groups of Ra and Rb may also be the same or different.

The hetero-aromatic group represented by Ra, Rb may be, for example, pyrrole, pyrazole, imidazole, 1,2,4-triazole, tetrazole, benzimidazole, benzoxazole, benzthiazole, 1,2,4-thiadiazole, pyridine, pyrimidine, triazine (s-triazine, 1,2,4-triazine), indazole, purine, quinoline, isoquinoline, quinazoline, pyrimidine, iso-oxazole, oxazole, thiazole, selenazole, tetra-azaindene, s-triazolo[1,5-a]pyrimidine, s-triazolo[1,5-b]pyridazine, penta-azaindene, s-triazolo(1,5-b)[1,2,4]triazine, s-triazolo(5,1-d)-us-triazine or triazaindene (imidazolo [4,5-b]pyridine). These hetero-aromatic groups may be further substituted with substituent groups. These substituent groups may be the same as those cited as such for the alkyl, alkenyl and aryl groups.

Examples of the nitrogen containing heterocyclic groups which are formed when Ra and Rb are joined together include the piperidyl, pyrrolidinyl, N-alkylpiperazyl, morpholyl, indolinyl and benztriazolyl groups.

The compounds from among those represented by formula (I) which are represented by formula (I-a) which is indicated below are preferred:

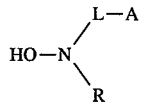

(I-a)

wherein L represents an alkylene group which may be substituted, A represents a carboxyl group, a sulfo group, a phosphono group, phosphinic acid residual group, a hydroxyl group, an amino group which may be substituted with alkyl groups, an ammonio group which may be substituted with alkyl groups, a carbamoyl group which may be substituted with alkyl groups, a sulfamoyl group which may be substituted with alkyl groups or an alkylsulfonyl group which may be substituted, and R represents a hydrogen atom or an alkyl group which may be substituted.

In formula (I-a), L represents an alkylene group which may be substituted. It is preferably a linear chain or branched chain alkylene group which has from 1 to 10 carbon atoms, and most desirably from 1 to 5 carbon atoms, and which may be substituted. Actual preferred examples include methylene, ethylene, trimethylene and propylene. Examples of substituent groups include carboxyl group, sulfo group, phosphono group, phosphinic acid residual group, hydroxyl group and ammonio groups which may be substituted with alkyl groups (preferably $C_1$–$C_5$ alkyl groups), and the carboxyl group, the sulfo group, the phosphono group and the hydroxyl group are examples of preferred substituent groups. A represents a carboxyl group, a sulfo group, a phosphono group, a phosphinic acid residual group, a hydroxyl group, an amino group which may be substituted with alkyl groups (preferably $C_1$–$C_5$ alkyl groups), an ammonio group which may be substituted with alkyl groups (preferably $C_1$–$C_5$ alkyl groups), a carbamoyl group which may be substituted with alkyl groups (preferably $C_1$–$C_5$ alkyl groups), a sulfamoyl group which may be substituted with alkyl groups (preferably $C_1$–$C_5$ alkyl groups), or an alkylsulfonyl group which may be substituted, and the preferred examples are carboxyl group, sulfo group, hydroxyl group, phosphono group and carbamoyl groups which may be substituted with alkyl groups. Preferred examples of -L-A include carboxymethyl, carboxyethyl, carboxypropyl, sulfoethyl, sulfopropyl, sulfobutyl, phosphonomethyl, phosphonoethyl and hydroxyethyl, and the most desirable examples of -L-A are carboxymethyl, carboxyethyl, sulfoethyl, sulfopropyl, phosphonomethyl and phosphonoethyl. R represents a hydrogen atom or a linear chain or branched chain alkyl group of carbon number from 1 to 10, and preferably of carbon number from 1 to 5, which may be substituted. Substituent groups include carboxyl group, sulfo group, phosphono group, phosphinic acid residual group, hydroxyl group, amino groups which may be substituted with alkyl groups, ammonio groups which may be substituted with alkyl groups, carbamoyl groups which may be substituted with alkyl groups, sulfamoyl groups which may be substituted with alkyl groups, alkylsulfonyl groups which may be substituted, acylamino groups, alkylsulfonylamino groups, arylsulfonylamino groups, alkoxycarbonyl groups, amino groups which may be substituted with alkyl groups, arylsulfonyl groups, nitro group, cyano group and halogen atoms. Two or more of these substituent groups may be present. Methyl, ethyl, propyl, hydrogen atom, carboxymethyl, carboxyethyl, carboxypropyl, sulfoethyl, sulfopropyl, sulfobutyl, phosphonomethyl, phosphonoethyl and hydroxyethyl are preferred examples of R, and R is most desirably a hydrogen atom or a carboxymethyl, carboxyethyl, sulfoethyl, sulfopropyl, phosphonomethyl or phosphonoethyl group. L and R may be connected to form a ring. The substituents represented by A or R in formula (I-a) (e.g., a carboxy group, a sulfo group, a carboxyalkyl group, a sulfoalkyl group) may be salts of alkali metals such as sodium and potassium.

Actual examples of compounds which can be represented by formula (I) of the present invention are indicated below, but these compounds are not limited by these examples.

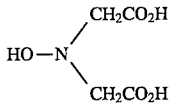
(I-1)

-continued

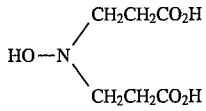
(I-2)

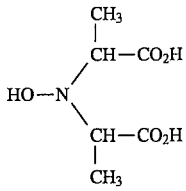
(I-3)

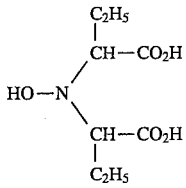
(I-4)

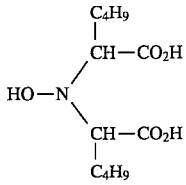
(I-5)

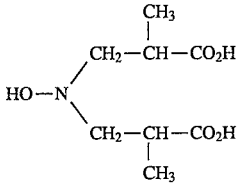
(I-6)

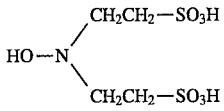
(I-7)

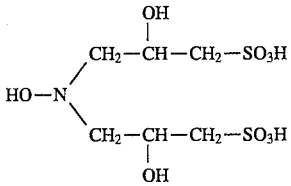
(I-8)

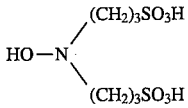
(I-9)

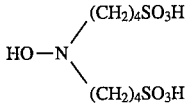
(I-10)

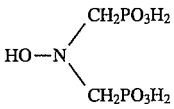
(I-11)

-continued
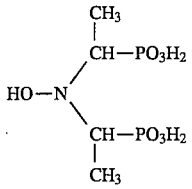
(I-12)
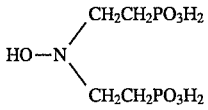
(I-13)
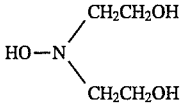
(I-14)
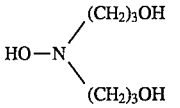
(I-15)
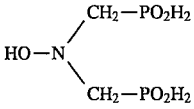
(I-16)
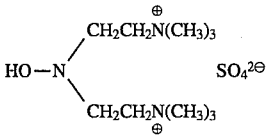
(I-17)
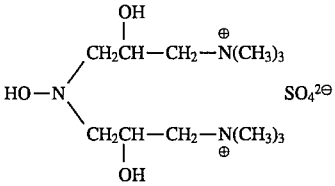
(I-18)
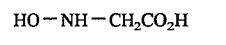
(I-19)
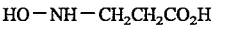
(I-20)
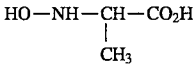
(I-21)
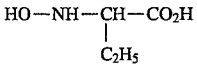
(I-22)
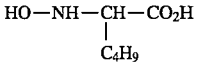
(I-23)
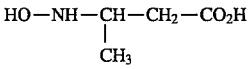
(I-24)
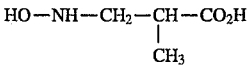
(I-25)
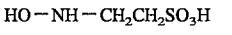
(I-26)
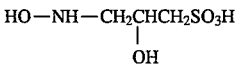
(I-27)
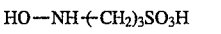
(I-28)
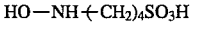
(I-29)
-continued
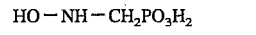
(I-30)
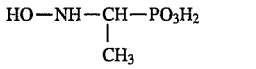
(I-31)
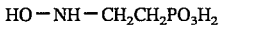
(I-32)
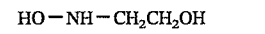
(I-33)
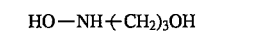
(I-34)
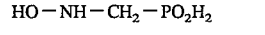
(I-35)
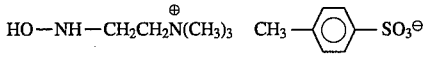
(I-36)
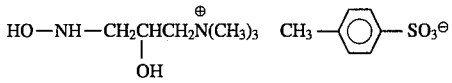
(I-37)
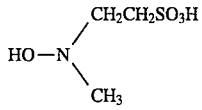
(I-38)
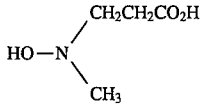
(I-39)
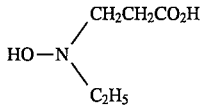
(I-40)
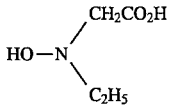
(I-41)
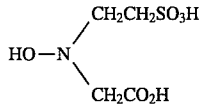
(I-42)
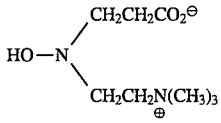
(I-43)
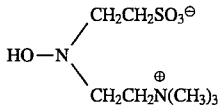
(I-44)
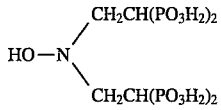
(I-45)
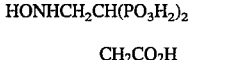
(I-46)
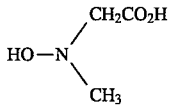
(I-47)
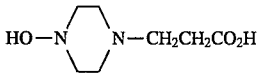
(I-48)

-continued (I-49)

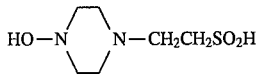

(I-50)

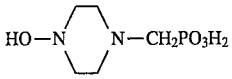

(I-51)

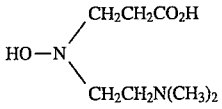

(I-52)

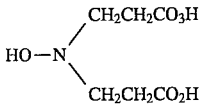

(I-53)

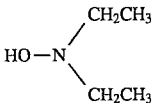

(I-54)

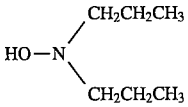

(I-55)

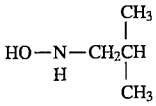

(I-56)

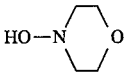

(I-57)

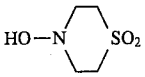

(I-58)

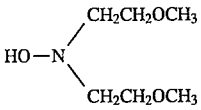

The hydroxylamine compounds represented by formula (I) can be prepared using the known methods disclosed in U.S. Pat. Nos. 3,661,996, 3,362,961, 3,293,034, JP-B-42-2794, and U.S. Pat. Nos. 3,491,151, 3,655,764, 3,467,711, 3,455,916, 3,287,125 and 3,287,124 (the term "JP-B" as used herein signifies an "examined Japanese patent publication").

These hydroxylamine compounds may form salts with various acids, such as hydrochloric acid, sulfuric acid, nitric acid, phosphoric acid, oxalic acid and acetic acid for example.

The hydrazine analogues (hydrazines and hydrazides) represented by formula (II) which can be used in this present invention are described in detail below, $R^1$, $R^2$ and $R^3$ each independently represents a hydrogen atom, a substituted or unsubstituted alkyl group (which preferably has from 1 to 20 carbon atoms, for example, methyl, ethyl, sulfopropyl, carboxybutyl, hydroxyethyl, cyclohexyl, benzyl, phenethyl), a substituted or unsubstituted aryl group (which preferably has from 6 to 20 carbon atoms, for example, phenyl, 2,5-dimethoxyphenyl, 4-hydroxyphenyl, 2-carboxyphenyl), or a substituted or unsubstituted heterocyclic group (which preferably has from 1 to 20 carbon atoms, and which preferably has a five or six membered ring with at least one oxygen, nitrogen or sulfur atom as a hetero atom, for example, pyridin-4-yl, N-acetylpiperidin-4-yl).

$R^4$ represents a hydrogen atom, a hydroxyl group, a substituted or unsubstituted hydrazino group (for example, hydrazino, methylhydrazino, phenylhydrazino), a substituted or unsubstituted alkyl group (which preferably has from 1 to 20 carbon atoms, for example, methyl, ethyl, sulfopropyl, carboxybutyl, hydroxyethyl, cyclohexyl, benzyl, tert-butyl, n-octyl), a substituted or unsubstituted aryl group (which preferably has from 6 to 20 carbon atoms, for example, phenyl, 2,5-dimethoxyphenyl, 4-hydroxyphenyl, 2-carboxyphenyl, 4-sulfophenyl), a substituted or unsubstituted heterocyclic group (which preferably has from 1 to 20 carbon atoms, and which preferably has a five or six membered ring containing at least one oxygen atom, nitrogen atom or sulfur atom as a hetero atom, for example, pyridin-4-yl, imidazolyl), a substituted or unsubstituted alkoxy group (which preferably has from 1 to 20 carbon atoms, for example, methoxy, ethoxy, methoxyethoxy, benzyloxy, cyclohexyloxy, octyloxy), a substituted or unsubstituted aryloxy group (which preferably has from 6 to 20 carbon atoms, for example, phenoxy, p-methoxyphenoxy, p-carboxyphenoxy, p-sulfophenoxy), a substituted or unsubstituted carbamoyl group (which preferably has from 1 to 20 carbon atoms, for example, unsubstituted carbamoyl, N,N-diethylcarbamoyl, phenylcarbamoyl), or a substituted or unsubstituted amino group (which preferably has from 0 to 20 carbon atoms, for example, amino, hydroxyamino, methylamino, hexylamino, methoxyethylamino, carboxyethylamino, sulfoethylamino, N-phenylamino, p-sulfophenylamino).

$R^1$, $R^2$, $R^3$ and $R^4$ may be further substituted, preferably with halogen atoms (for example, chlorine, bromine), hydroxyl groups, carboxyl groups, sulfo groups, amino groups, alkoxy groups, amido groups, sulfonamido groups, carbamoyl groups, sulfamoyl groups, alkyl groups, aryl groups, aryloxy groups, alkylthio groups, arylthio groups, nitro groups, cyano groups, sulfonyl groups and sulfinyl groups for example, and these may be further substituted.

$X^1$ is preferably a divalent organic residual group, and in practice is, for example, —CO—, —SO— or $$-\overset{\overset{\displaystyle NH}{\|}}{C}-.$$

Moreover, n represents 0 or 1, but when n is 0 then $R^4$ represents a group selected from among the substituted or unsubstituted alkyl groups, aryl groups and heterocyclic groups. $R^1$ and $R^2$, and $R^3$ and $R^4$, may be joined together to form a heterocyclic ring. In those cases where n is 0, it is desirable that at least one of $R^1$ to $R^4$ should be a substituted or unsubstituted alkyl group. Those cases in which $R^1$, $R^2$, $R^3$ and $R^4$ are hydrogen atoms or substituted or unsubstituted alkyl groups are especially desirable (but $R^1$, $R^2$, $R^3$ and $R^4$ cannot all be hydrogen atoms at the same time). Those cases in which $R^1$, $R^2$ and $R^3$ are hydrogen atoms and $R^4$ is a substituted or unsubstituted alkyl group, those cases in which $R^1$ and $R^3$ are hydrogen atoms and $R^2$ and $R^4$ are substituted or unsubstituted alkyl groups, and those cases in which $R^1$ and $R^2$ are hydrogen atoms and $R^3$ and $R^4$ are substituted or unsubstituted alkyl groups (where $R^3$ and $R^4$ may be combined to form a heterocyclic ring) are the most desirable. In those cases where n is 1, $X^1$ is preferably —CO—, $R^4$ is preferably a substituted or unsubstituted amino group and $R^1$ to $R^3$ are preferably hydrogen atoms or substituted or unsubstituted alkyl groups.

Those cases in which n is 0 are more preferred.

Alkyl groups which have from 1 to 10 carbon atoms are preferred for the alkyl groups represented by $R^1$–$R^4$, and alkyl groups which have from 1 to 7 carbon atoms are the most desirable. Furthermore, hydroxyl groups, carboxylic acid groups, sulfonic acid groups and phosphonic acid groups are the preferred substituents for the alkyl groups. In those cases where there are two or more substituent groups these may be the same or different.

The compounds represented by formula (II) may also take the form of dimers, trimers or polymers which are linked via $R^1$, $R^2$, $R^3$ or $R^4$.

Actual examples of compounds which can be represented by formula (II) are indicated below, but the invention is not limited by these examples.

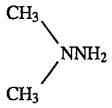
(II-1)

$CH_3NHNHCH_3$ (II-2)

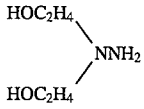
(II-3)

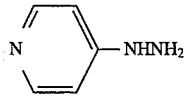
(II-4)

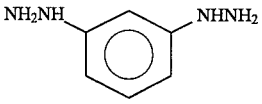
(II-5)

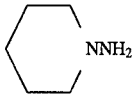
(II-6)

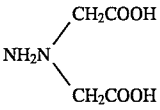
(II-7)

$HOOCCH_2NHNHCH_2COOH$ (II-8)

$NH_2NH(CH_2)_5NHNH_2$ (II-9)

$NH_2NHCH_2CH_2OH$ (II-10)

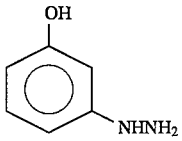
(II-11)

$NH_2NH(CH_2)_5SO_3H$ (II-12)

$NH_2NH(CH_2)_4SO_3H$ (II-13)

$NH_2NH(CH_2)_5COOH$ (II-14)

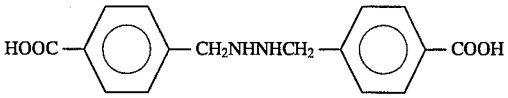
(II-15)

-continued

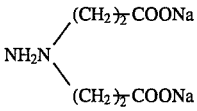
(II-16)

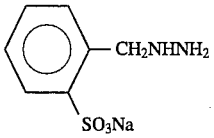
(II-17)

$NaOOCCH(CH_3)NHNHCH(CH_3)COONa$ (II-18)

$NH_2NHCH_2CH_2COONa$ (II-19)

$NH_2NHCH_2COONa$ (II-20)

$H_2NNHCH_2CH_2SO_3Na$ (II-21)

$H_2NNHCH(C_4H_9(n))COOH$ (II-22)

$H_2NNHCH(C_6H_{13}(n))COOH$ (II-23)

$H_2NN(CH(C_4H_9(n))COOH)_2$ (II-24)

$H_2NN(CH_2CH_2SO_3Na)_2$ (II-25)

$H_2NN(CH_2CH_2CH_2SO_3Na)_2$ (II-26)

$H_2NN(CH(C_2H_5)COOH)_2$ (II-27)

$H_2NNHCH(CH_3)COOH$ (II-28)

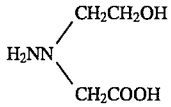
(II-29)

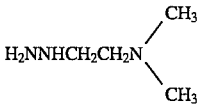
(II-30)

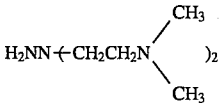
(II-31)

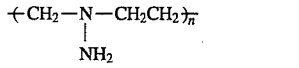
(II-32)

Average molecular weight about 4,000

-continued
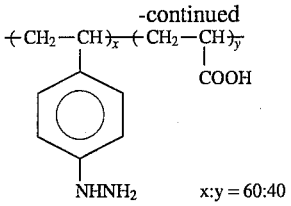
(II-33)
x:y = 60:40
Average molecular weight about 20,000
$NH_2NHCONH_2$ (II-34)
$NH_2NHC(=NH)NH_2$ (II-35)
$NH_2NHCONHNH_2$ (II-36)
$NH_2NHSO_3H$ (II-37)
$NH_2NHSO_2NHNH_2$ (II-38)
$CH_3NHNHSO_2NHNHCH_3$ (II-39)
$NH_2NHCONH(CH_2)_3NHCONHNH_2$ (II-40)
(II-41)
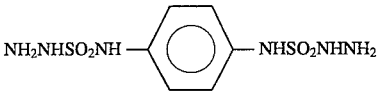
$NH_2NHCOCONHNH_2$ (II-42)
(II-43)
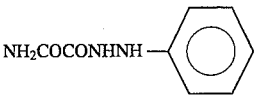
(II-44)
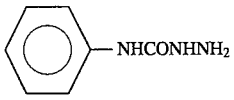
(II-45)
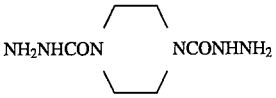
$NH_2COCONHNH_2$ (II-46)
(II-47)
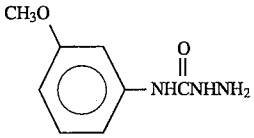
(II-48)
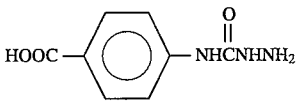
(II-49)
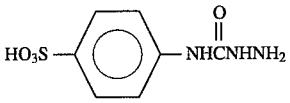
(II-50)
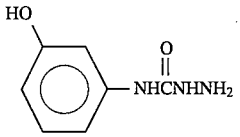
-continued
(II-51)
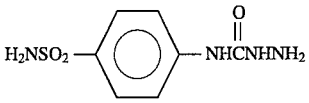
(II-52)
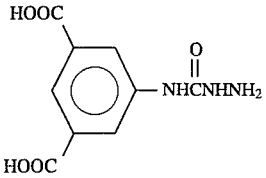
(II-53)
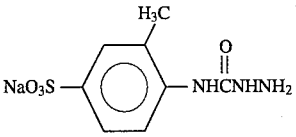
(II-54)
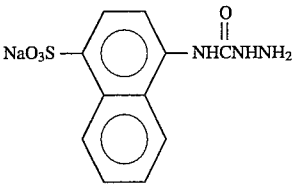
(II-55)
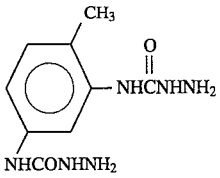
(II-56)
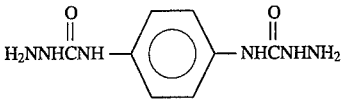
(II-57)
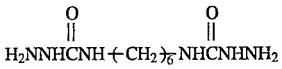
(II-58)
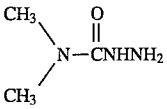
(II-59)
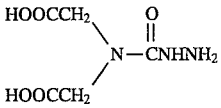
(II-60)
$NaO_3SCH_2CH_2NHC(=O)NHNH_2$
(II-61)
$HOOCCH_2CH_2NHC(=O)NHNH_2$
(II-62)
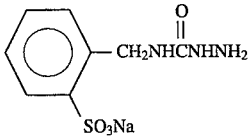
$NH_2NHCOOC_2H_5$ (II-63)
$NH_2NHCOCH_3$ (II-64)

-continued (II-65)

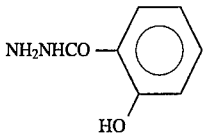

(II-66)

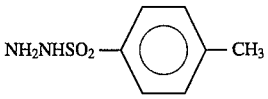

(II-67) $NH_2NHCH_2PO_3H_2$ (II-68)

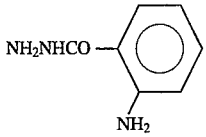

(II-69)

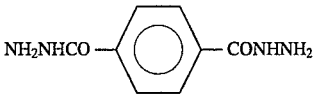

(II-70)

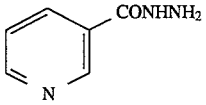

(II-71)

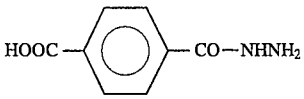

(II-72)

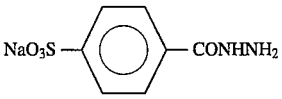

(II-73) $(CH_3)_3CCONHNH_2$ (II-74) $(CH_3)_3CC(=O)NHNH_2$ (II-75)

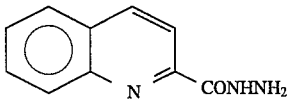

(II-76)

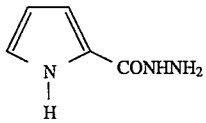

(II-77)

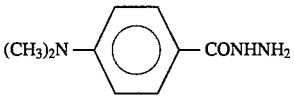

(II-78)

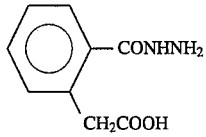

(II-79)

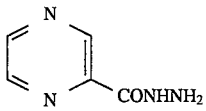

(II-80) $HOCH_2CH_2SO_2NHNH_2$ (II-81) $NaO_3SCH_2CH_2CONHNH_2$

-continued (II-82) $H_2NCONHCH_2CH_2SO_2NHNH_2$ (II-83)

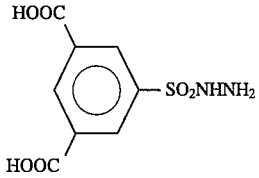

(II-84)

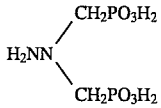

(II-85) $H_2NNHCH_2CH_2PO_3H_2$ (II-86)

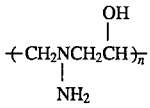

Average molecular weight: 1,000

The compounds disclosed in JP-A-63-146041 (pages 11 to 24 of the specification of Japanese patent application No. 61-170756), JP-A-63-146042 (on pages 12 to 22 of the specification of Japanese patent application No. 61-171682) and JP-A-63-146043 (pages 9 to 19 of the specification of Japanese patent application No. 61-173468) can also be cited as actual examples of such compounds in addition to those indicated above.

Many of the compounds represented by the formula (II) are available as commercial products, and they can also be prepared on the basis of the general methods of preparation described, for example, in *Organic Syntheses,* Coll. Vol. 2, pp 208–213; *J. Am. Chem. Soc.,* 36, 1747 (1914); *Yukaguku,* 34, 31 (1975); *J. Org. Chem.,* 25, 44 (1960), *Yakugaku Zasshi,* 91, 1127 (1971), *Organic Syntheses,* Coll. Vol. 1, p. 450, *Shinjikken Kagaku Koza,* Vol. 14, III, p. 1621–1628 (Maruzen); *Beil.,* 2, 559; Beil., 3, 117; E. B. Mohr et al., *Inorgan. Syn.,* 4, 32 (1953); J. F. Wilson and E. C. Pickering, *J. Chem. Soc.,* 123, 394 (1932); N. J. Leonard, J. H. Boyer, *J. Org. Chem.,* 15, 42 (1950); *Organic Syntheses,* Coll Vol. 5, p. 1055;, P. A. S. Smith, *Derivatives of Hydrazine and Other Hydronitrogens Having N-N* bonds, pages 120–124, pages 130–131; The Benjamin/Cummings Co., 1983; and Staniey R. Sandier Waif Karo, *Organic Functional Group Preparations,* Vol. 1, Second Edition, page 457.

The amounts of the compounds of formula (I) and/or (II) of the present invention added to the bleach-fixer is from 0.1 to 20 grams/liter, and preferably from 0.5 to 10 grams/liter. Further, the compounds may be used in a color development bath which is the pre-bath of the bleach-fix bath and carried-over into the bleach-fix bath with the processing of light-sensitive materials so that the bleach-fix bath may have the above mentioned concentration. Furthermore, on starting continuous processing using a bleach-fixer with the above mentioned concentration, the system may be used in such a way that the concentration is maintained by carry-over from a pre-bath.

Formulae (A), (B), (C) and (D) are described below.

Formula (A) is described in detail below. $R_1$ represents a hydrogen atom, or a substituted or unsubstituted alkyl group (for example, methyl, ethyl, methoxyethyl, carboxymethyl, sulfomethyl, sulfoethyl), alkenyl group (for example, allyl), aralkyl group (for example, benzyl, phenethyl, 4-methylbenzyl, 4-sulfobenzyl), cycloalkyl group (for example, cyclohexyl), aryl group (for example phenyl, naphthyl, 3-sulfobutoxyphenyl, 4-N-methyl-N-sulfopropylaminophenyl, 3-sulfopropylphenyl, 3-carboxyphenyl), heterocyclic group (for example, pyridyl, thienyl, pyrrolyl, indolyl, furyl, furfuryl, morpholinyl, imidazolyl), ester group (for example, methoxycarbonyl, ethoxycarbonyl), acyl group (for example, acetyl, methoxypropionyl), carbamoyl group (for example, unsubstituted carbamoyl, dimethylcarbamoyl) or a carboxylic acid group or a salt thereof. Examples of the substituted and unsubstituted alkyl groups, alkenyl groups, aralkyl groups, cycloalkyl groups, aryl groups and heterocyclic groups represented by $R_2$ are the same as those described in connection with $R_1$. Furthermore, $R_1$ and $R_2$ may be combined to form a saturated or unsaturated five to seven membered ring.

In formula (A), $R_1$ and $R_2$ preferably represent hydrogen atoms, or substituted or unsubstituted alkyl groups, aryl groups or heterocyclic groups.

In formula (A), $R_1$ most desirably represents a hydrogen atom and $R_2$ most desirably represents a substituted or unsubstituted aryl group or a heterocyclic group. Furthermore, in the case of a substituted aryl group the sum of the Hammett substituent constants ($\sigma$-values) of the substituent groups is from −1.2 to 1.0, and it is desirable that at least one of the substituent groups is a sulfo group, a carboxyl group, a sulfino group, a phosphono group or an ammonio group. The expression "Hammett $\sigma$-value" as used herein signifies the $\sigma$-value as disclosed in *J. Med. Chem.* 16, 1207 (1973) and ibid 20, 304 (1977).

Formula (B) is described in detail below. The substituted or unsubstituted alkyl groups, alkenyl groups, aralkyl groups, cycloalkyl groups, aryl group, heterocyclic groups, ester groups, acyl groups and carbamoyl groups represented by $R_3$, $R_4$ and $R_5$ are the same as those described in connection with $R_1$, and $R_3$, $R_4$ and $R_5$ may also represent halogen atoms (for example, chlorine), sulfo groups or salts thereof, or substituted or unsubstituted ether groups (for example, methoxy, phenoxy), sulfinyl groups (for example, methanesulfinyl), sulfonyl groups (for example, methanesulfonyl, benzenesulfonyl, 4-methylbenzenesulfonyl), or sulfamoyl groups (for example, unsubstituted sulfamoyl, dimethylsulfamoyl). $R_3$, $R_4$ and $R_5$ may further represent carboxylic acid groups, cyano groups and nitro groups. Furthermore, $R_6$ is preferably an electron attractive group (a group of which the aforementioned Hammett $\sigma$-value is preferably from 0 to 1.0, for example, nitro, cyano, sulfonyl, acyl, ester).

In formula (B), $R_3$, $R_4$ and $R_5$ preferably represent hydrogen atoms, carboxylic acid groups, cyano groups, or substituted or unsubstituted alkyl groups, aryl groups, heterocyclic groups, ester groups or acyl groups, and $R_6$ preferably represents a nitro group, a cyano group or a substituted or unsubstituted acyl group or ester group.

Formula (C) is described in detail below. The substituted or unsubstituted alkyl groups, alkenyl groups, cycloalkyl groups, aralkyl groups, aryl groups, heterocyclic groups, ester groups, acyl groups and ether groups represented by $R_7$, $R_8$ and $R_9$ are the same as those described in connection with $R_1$, and $R_7$, $R_8$ and $R_9$ also represent substituted or unsubstituted amino groups (for example, unsubstituted amino, dimethylamino, carboxymethylamino), substituted or unsubstituted thioether groups (for example, methylthio, methylthiomethylthio), carboxylic acid groups and hydroxyl groups. X represents an anion (for example, chlorine ion, bromine ion, p-toluenesulfanate ion, perchlorate ion).

In formula (C), $R_7$, $R_8$ and $R_9$ are preferably hydrogen atoms or substituted or unsubstituted alkyl groups, aryl groups, heterocyclic groups or amino groups.

Formula (D) is described in detail below. $R_{10}$ represents a substituted or unsubstituted alkyl group (for example, methyl, ethyl, sulfoethyl, sulfobutyl, sulfopropyl, carboxymethyl, dimethylaminoethyl, 2,2,2-trifluoroethyl), alkenyl group (for example, allyl), aralkyl group (for example, benzyl, phenethyl), cycloalkyl group (for example, cyclohexyl), aryl group (for example, phenyl, naphthyl, 4-methoxyphenyl, 3-sulfopropylphenyl), heterocyclic group (for example, pyridyl, pyrazolyl, imidazolyl), or hydrogen atom, $R_{11}$ represents the substituent groups described for $R_{10}$ and halogen groups (for example, chloro, bromo), cyano group, nitro group, sulfo group, carboxyl group and substituted or unsubstituted ether groups (for example, methoxy, isopropyloxy, butoxy), substituted or unsubstituted acyl groups (for example, acetyl, benzoyl, butanoyl), substituted or unsubstituted carbamoyl groups (for example, ethylcarbamoyl, dimethylcarbamoyl), substituted or unsubstituted dialkylamino groups (for example, dimethylamino, dihydroxyethylamino) and substituted or unsubstituted ester groups (for example, methoxycarbonyl, acetoxy), and Z represents a five or six membered heterocyclic ring comprised of carbon atoms, nitrogen atoms, oxygen atoms, sulfur atoms, or selenium atoms (for example, a pyridinium ring, an imidazolium ring, a quinolinium ring, an oxazolium ring, a thiazolium ring or a benzimidazolium ring). Z may have a substituent. Y represents an anion (for example, chlorine ion, bromine ion, p-toluenesulfonate ion).

In formula (D), $R_{10}$ preferably represents a substituted or unsubstituted alkyl group, $R_{11}$ preferably represents a substituted or unsubstituted alkyl group or a hydrogen atom, and Z preferably represents an imidazolium ring, a benzimidazolium ring, or a quinolinium ring.

Actual examples of compounds of formulae (A)–(D) which can be used in this present invention are indicated below, but the invention is not limited by these examples.

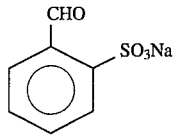

A-1

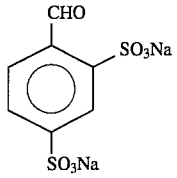

A-2

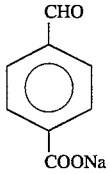

A-3

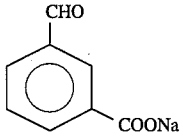

A-4

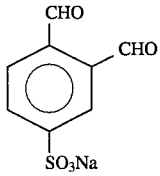

A-5

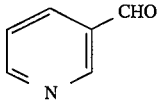

A-6

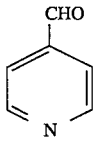

A-7

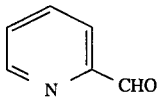

A-8

-continued
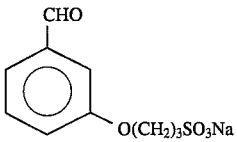
A-9
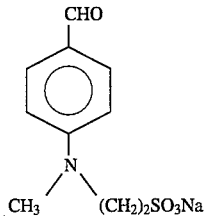
A-10
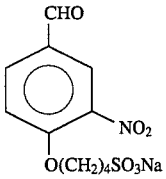
A-11
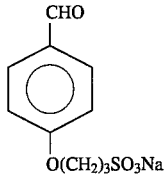
A-12
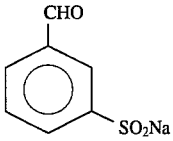
A-13
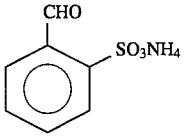
A-14
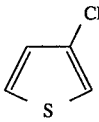
A-15
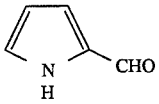
A-16
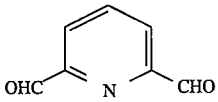
A-17
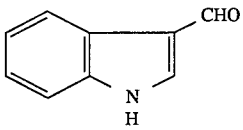
A-18
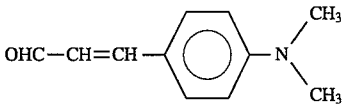
A-19
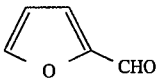
A-20
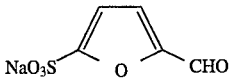
A-21
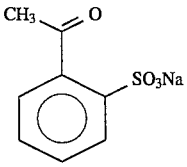
A-22
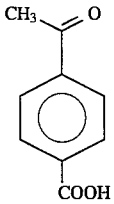
A-23
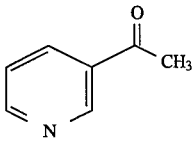
A-24
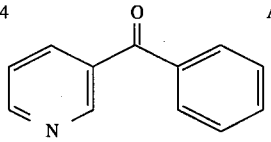
A-25
$NaO_3SCH_2CH_2CHO$
A-26
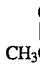
A-27
A-28
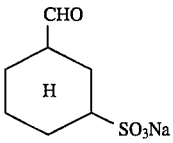
A-29
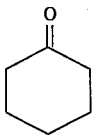
-continued
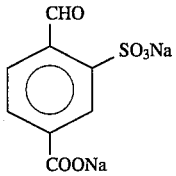
A-30
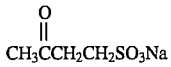
A-31
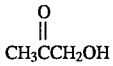
A-32
$CH_3OCH_2CHO$
A-33
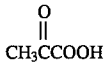
A-34
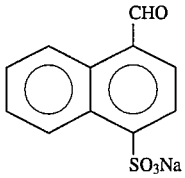
A-35
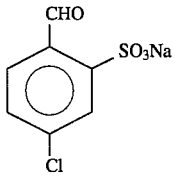
A-36
$OHC(CH_2)_4CHO$
A-37
$OHC(CH_2)_2CHO$
A-38
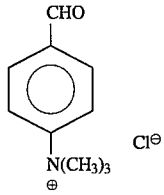
A-39
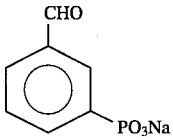
A-40
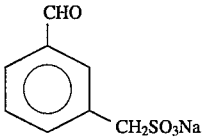
A-41
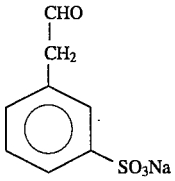
A-42
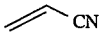
B-1
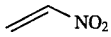
B-2
$NC.CH{=}CHSO_3Na$
B-3
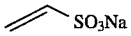
B-4
$O_2NCH{=}CHSO_3Na$
B-5
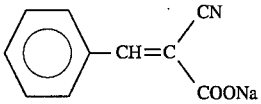
B-6
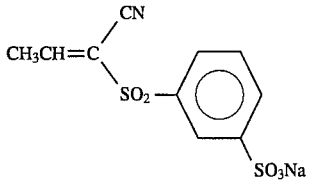
B-7
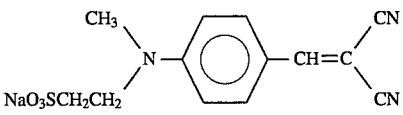
B-8

-continued

B-9

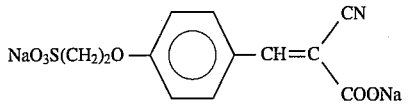

C-1

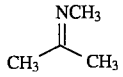

C-2

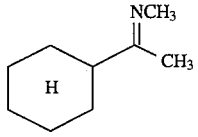

C-3

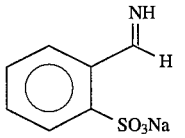

C-4

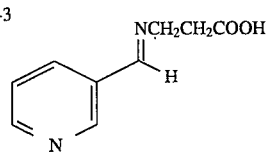

C-5

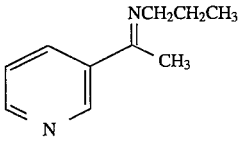

C-6

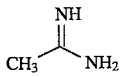

C-7

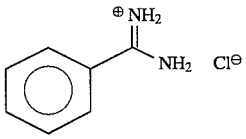

C-8

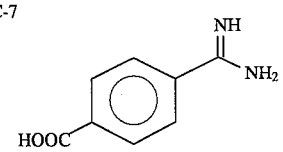

C-9

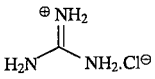

C-10

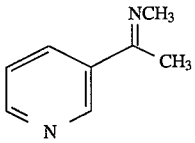

C-11

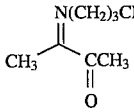

C-12

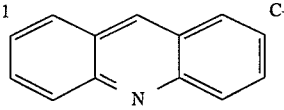

C-13

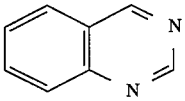

C-14

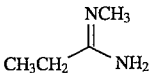

C-15

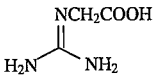

C-16

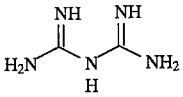

D-1

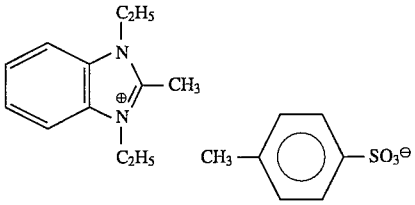

D-2

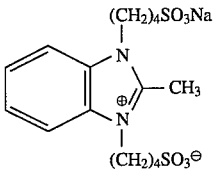

D-3

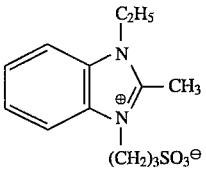

D-4

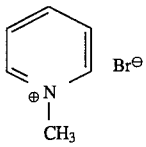

D-5

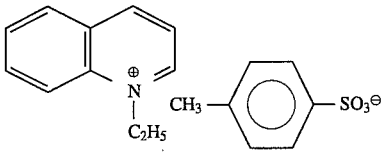

D-6

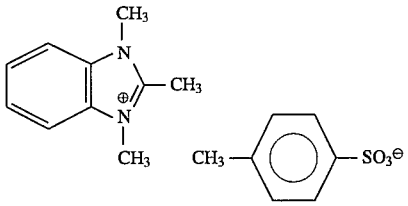

D-7

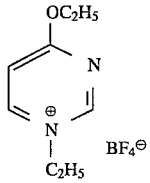

D-8

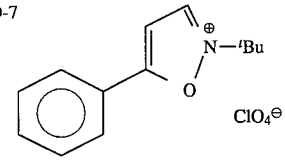

D-9

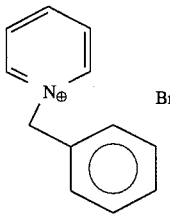

D-10

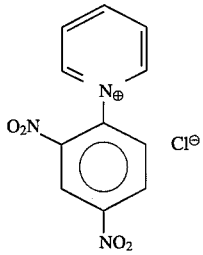

D-11

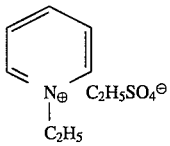

Many of these compounds can be obtained commercially and used without further treatment. Furthermore, the other compounds can be prepared using known organic synthetic reactions. For example, they can be prepared using the methods described in *Organic Syntheses* Collective Vol. I, 537 (1941), ibid, Collective Vol. III, 564 (1955), *Organic Reaction,* 16, 1 (1968), S. R. Sandler and W. Carllo, *Organic Functional Group preparations,* volume 2, page 291 (1986), and ibid, volume 3, page 205 (1972).

Of the formulae (A), (B), (C) and (D), formula (A) is particularly preferred in view of the effects of the present invention.

The amount of the compounds represented by the above mentioned formulae (A), (B), (C) and (D) added to the bleachfixer is from 0.01 to 1.0 mol/liter, and preferably from 0.03 to 0.5 mol/liter. These compounds are compounds which form adducts with bisulfite, and their addition in the form of bisulfite adducts is most desirable. Alternatively, in a preferred embodiment a sulfite or bisulfite is added separately in an amount of from 0.5 to 2 mol equivalent with respect to the above mentioned compounds.

The processing steps in the present invention are described below.

A color development step, a bleach-fixing step and a water washing step and/or stabilizing step are required in the processing steps in the present invention.

The known primary aromatic amine color developing agents are included in the color developers which are used in the present invention. The p-phenylenediamine derivatives are preferred and some typical examples of these are indicated below, but the developing agent is not limited by these examples.

(D-1) N,N-Diethyl-p-phenylenediamine
(D-2) 2-Amino-5-diethylaminotoluene
(D-3) 2-Amino-5-(N-ethyl-N-laurylamino)toluene
(D-4) 4-[N-Ethyl-N-(β-hydroxyethyl)amino]aniline
(D-5) 2-Methyl-4-[N-ethyl-N-(β-hydroxyethyl)amino] aniline
(D-6) 4-Amino-3-methyl-N-ethyl-N-[β-(methanesulfonamido)ethyl]aniline
(D-7) N-(2-Amino-5-diethylaminophenylethyl) methanesulfonamide
(D-8) N,N-Dimethyl-p-phenylenediamine
(D-9) 4-Amino-3-methyl-N-ethyl-N-methoxyethylaniline
(D-10) 4-Amino-3-methyl-N-ethyl-N-β-ethoxyethylaniline
(D-11) 4-Amino-3-methyl-N-ethyl-N-β-butoxyethylaniline 4-Amino-3-methyl-N-ethyl-N-[β-(methanesulfonamido) ethyl]aniline (illustrative compound D-6) is preferred from among the above mentioned p-phenylenediamine derivatives.

Furthermore, these p-phenylenediamine derivatives may take the form of salts, such as their sulfates, hydrochlorides, sulfites or p-toluenesulfonates for example. The amount of the primary aromatic amine developing agent used is preferably from about 0.1 to about 20 grams, and most desirably from about 0.5 to about 10 grams, per liter of color developer.

Furthermore, sulfites such as sodium sulfite, potassium sulfite, sodium bisulfite, potassium bisulfite, sodium metabisulfite and potassium metabisulfite for example, and carbonyl/sulfurous acid adducts can be added, as required, to the color developer as preservatives.

The addition of various hydroxylamines, the hydroxamic acids disclosed in JP-A-63-43138, the hydrazines and hydrazides disclosed in U.S. Pat. No. 4,801,521, the phenols disclosed in JP-A-63-44657 and JP-A-63-58443, the α-hydroxyketones and α-aminoketones disclosed in JP-A-63-44656 and/or the various sugars disclosed in JP-A-63-36244 as compounds which directly preserve the aforementioned primary aromatic amine color developing agents is desirable. Furthermore, the conjoint use with the compounds mentioned above of the monoamines disclosed, for example, in JP-A-63-4235, JP-A-63-24254, JP-A-63-21647, and U.S. Pat. No. 4,851,325, JP-A-63-27841 and JP-A-63-25654, the diamines disclosed, for example, in JP-A-63-30845, JP-A-63-146040 and JP-A-63-43139, and the polyamines disclosed in JP-A-63-21647 and JP-A-63-26655, the polyamines disclosed in JP-A-63-44655, the nitroxy radicals disclosed in JP-A-63-53551, the alcohols disclosed in JP-A-63-43140 and JP-A-63-53549, the oximes disclosed in JP-A-63-56654 and the tertiary amines disclosed in U.S. Pat. No. 4,798,783 is desirable. Cases in which compounds represented by the aforementioned formula (II) are used are especially desirable.

The various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349 and the aromatic polyhydroxy compounds disclosed in U.S. Pat. No. 3,746,544, for example, may also be included, as desired, as preservatives. The addition of the aromatic polyhydroxy compounds or triethanol amines is particularly preferred.

The color developer used in this present invention is preferably of pH from 9 to 12, and most desirably of pH from 9 to 11.0, and other already known developer component compounds can be included in the color developer.

The use of various buffers is preferred for maintaining the above mentioned pH value. Carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, tris-hydroxyaminomethane salts and lysine salts, for example, can be used as buffers. The use of carbonates, phosphates, tetraborates and hydroxybenzoates as buffers is especially desirable in view of their advantages in terms of solubility, excellent buffering capacity in the high pH region above pH 9.0, their lack of adverse effect (fogging for example) on photographic performance when added to a color developer and cheapness.

Actual examples of these buffers include sodium carbonate, potassium carbonate, sodium bicarbonate, potassium bicarbonate, tri-sodium phosphate, tri-potassium phosphate, di-sodium phosphate, di-potassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited to these compounds.

The amount of the buffer added to the color developer is preferably at least 0.1 mol/liter, and most desirably from 0.1 to 0.4 mol/liter.

Various chelating agents can also be used in the color developer for preventing the precipitation of calcium and magnesium or for raising the stability of the color developer.

Organic compounds are preferred as the chelating agents, and examples include aminopolycarboxylic acids disclosed, for example, in JP-B-48-30496 and JP-B-44-30232, the organic phosphonic acids disclosed, for example in JP-A-56-97347, JP-B-56-39359 and West German Patent 2,227,639, the phosphonocarboxylic acids disclosed, for example, in JP-A-52- 102726, JP-A-53-42730, JP-A-54-121127, JP-A-55-126241 and JP-A-55-659506, and the other compounds disclosed, for example, in JP-A-58-195845, JP-A-58-203440 and JP-B-53-40900.

Actual examples of chelating agents include nitrilo triacetic acid, diethylenetriamine penta-acetic acid, ethylenediamine tetra-acetic acid, N,N,N-trimethylenephosphonic acid, ethylenediamine-N,N,N',N'-tetramethylenephosphonic acid, trans-cyclohexanediamine tetra-acetic acid, 1,2-diaminopropane tetra-acetic acid, glycol ether diamine tetra-acetic acid, ethylenediamine o-hydroxyphenylacetic acid, 2-phosphonobutane-1,2,4-tricarboxylic acid, 1-hydroxyethylidene-1,1-diphosphonic acid, hydroxyethylimino di-acetic acid and N,N'-bis(2 -hydroxybenzyl)ethylenediamine-N,N'-diacetic acid.

Two or more of these chelating agents can be used conjointly, as required.

The amount of these chelating agents added should be sufficient to sequester the metal ions in the color developer. For example, they are used in amounts of from 0.1 to 10 grams per liter.

Optional development accelerators can be added to the color developer as required. However, the color developer in the present invention is preferably essentially free of benzyl alcohol from the viewpoints of its pollution properties, solution preparation and the prevention of color staining and image storage properties. Here, the term "essentially free of benzyl alcohol" signifies that the concentration in the developer is not more than 2 ml per liter, and preferably that the developer contains no benzyl alcohol at all.

Thus, the thioether based compounds disclosed, for example, in JP-B-37-16088, JP-B-37-5987, JP-B-38-7826, JP-B-44-12380, JP-B-45-9019 and U.S. Pat. No. 3,813,247, the p-phenylenediamine based compounds disclosed in JP-A-52-49829 and JP-A-50-15554, the quaternary ammonium salts disclosed, for example, in JP-A-50-137726, JP-B-44-30074, JP-A-56-156826 and JP-A-52-43429, the amine based compounds disclosed, for example, in U.S. Pat. Nos. 2,494,903, 3,128,182, 4,230,796 and 3,253,919, JP-B-41-11431 and U.S. Pat. Nos. 2,482,546, 2,596,926 and 3,582,346, the polyalkylene oxides disclosed, for example, in JP-B-37-16088, JP-B-42-25201, U.S. Pat. No. 3,128,183, JP-B-41-11431, JP-B-42-23883 and U.S. Pat. No. 3,532,501, and 1-phenyl-3-pyrazolidones and imidazoles, for example, can also be added, as desired, as development accelerators.

Optional anti-foggants can be added, as desired, in the present invention. Alkali metal halides such as sodium chloride, potassium bromide and potassium iodide, and organic anti-foggants, can be used for this purpose. Typical examples of organic anti-foggants include nitrogen containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine and adenine.

Fluorescent whitening agents are preferably included in the color developer which is used in the present invention. The 4,4'-diamino-2,2'-disulfostilbene based compounds are preferred as fluorescent whitening agents. They are added in amounts of from 0 to 5 g/liter, and preferably in amounts of from 0.1 to 4 g/liter.

Furthermore, various surfactants, such as alkylsulfonic acids, arylphosphonic acids, aliphatic carboxylic acids and aromatic carboxylic acids for example, may be added, as desired.

The processing temperature in the color developer in the present invention is from 20° C. to 50° C., and preferably from 30° C. to 40° C. The processing time is from 20 seconds to 5 minutes, and preferably from 30 seconds to 2 minutes. A low replenishment rate is preferred, and a replenishment rate of from 20 to 1000 ml per square meter of photographic material is desirable, while replenishment rates of from 50 to 300 ml per square meter of photographic material are even more desirable. The rate of replenishment is most desirably from 60 ml to 200 ml per square meter of photographic material.

The de-silvering process in the present invention is described below. The de-silvering process of the present invention is generally carried out directly without an intermediate bath such as a water wash for example, and it may be comprised of a fixing process and a bleach-fixing process, a bleaching process and a bleach-fixing process or a bleach-fixing process, but a bleach-fixing process is preferred. The de-silvering process time in the present invention is preferably not more than 3 minutes, and most desirably from 15 seconds to 60 seconds.

The bleach-fixer which is used in the present invention is described below. The bleach-fixer of the present invention contains various compounds in addition to compounds represented by the formulae (I), (II), (A), (B), (C) and (D).

Any bleaching agent can be used for the bleaching agent which is used in the bleach-fixer which is used in the present invention, but organic complex salts of iron(III) (for example complex salts with aminopolycarboxylic acids such as ethylenediamine tetra-acetic acid and diethylenetriamine penta-acetic acid for example, aminopolyphosphonic acids, phosphonocarboxylic acids and organic phosphonic acids), or organic acids such as citric acid, tartaric acid or malic acid for example; persulfates; and hydrogen peroxide, for example, are preferred.

Of these, the organic complex salts of iron(III) are preferred from the viewpoints of rapid processing and the prevention of environmental pollution. Examples of the aminopolycarboxylic acids, aminopolyphosphonic acids and organic phosphonic acids, and salts thereof, which are useful for forming organic complex salts of iron(III) include ethylenediamine tetra-acetic acid, diethylenetriamine penta-acetic acid, 1,3-diaminopropane tetra-acetic acid, propylenediamine tetra-acetic acid, nitrilotriacetic acid, cyclohexanediamine tetra-acetic acid, methyliminodiacetic acid, iminodiacetic acid and glycol ether diamine tetra-acetic acid.

These compounds may take the form of sodium, potassium, lithium or ammonium salts. The iron(III) complex salts of ethylenediamine tetra-acetic acid, diethylenetriamine penta-acetic acid, cyclohexanediamine tetra-acetic acid, 1,3-diaminopropane tetra-acetic acid and methyliminodiacetic acid from among these compounds are preferred from the viewpoint of their high bleaching power.

These ferric ion complex salts may be used in the form of the complex salts, or the ferric ion complex salts can be formed in solution using a ferric salt, for example, ferric sulfate, ferric chloride, ferric nitrate, ferric ammonium sulfate or ferric phosphate, and a chelating agent such as an aminopolycarboxylic acid, an aminopolyphosphonic acid or a phosphonocarboxylic acid. Furthermore, the chelating agent may be used in excess over the amount required to form the ferric ion complex salt. From among the iron complex salts, the aminopolycarboxylic acid iron complex salts are preferred.

The amount of bleaching agent added is generally from 0.05 to 1.0 mol/liter, and preferably from 0.1 to 0.5 mol/liter. The de-silvering time is slow in cases where the bleaching agent concentration exceeds the above mentioned range and this is undesirable.

Re-halogenating agents, such as bromides (for example potassium bromide, sodium bromide, ammonium bromide) or chlorides (for example potassium chloride, sodium chloride, ammonium chloride) or iodides (for example ammonium iodide) can also be included in the bleach-fixers which is used in the present invention. One or more inorganic acid or organic acid, or the alkali metal or ammonium salts thereof, which have a pH buffering action, such as boric acid, borax, sodium metaborate, acetic acid, sodium acetate, sodium carbonate, potassium carbonate, phosphorous acid, phosphoric acid, sodium phosphate, citric acid, sodium citrate and tartaric acid, and corrosion inhibitors such as ammonium nitrate and guanidine for example, can be added as required.

Thiosulfates such as sodium thiosulfate and ammonium thiosulfate for example, can be used as fixing agents in the bleach-fixer in the present invention. Special bleach-fixers consisting of a combination of large quantities of a halide such as potassium iodide and a fixing agent as disclosed in JP-A-55-155354 can also be used. Thiocyanate and thioethers may also be added, as desired. The amount of thiosulfate per liter is preferably within the range from 0.1 to 2 mol, and most desirably within the range from 0.2 to 1.0 mol. The pH range of the bleach-fixer is preferably from 3 to 10, more preferably from 4 to 9, and most desirably from 5 to 6.5.

It is preferred that the bleach-fixer used in the present invention does not substantially contain benzyl alcohol. That is, by using the color developer and the bleach-fixer each containing substantially no benzyl alcohol, the effect of the present invention is revealed more clearly.

Furthermore, various fluorescent whiteners, anti-foaming agents or surfactants, polyvinylpyrrolidone and organic solvents such as methanol can be included in the bleach-fixer.

Various bleaching accelerators can also be used.

For example, the compounds which have a mercapto group or a disulfide group disclosed in U.S. Pat. No. 3,893,858, West German Patent 1,290,812, British Patent 1,138,842, JP-A-53-95630 and *Research Disclosure,* No. 17129 (July, 1978); the thiazolidine based derivatives disclosed in JP-A-50-140129, the thiourea derivatives disclosed in U.S. Pat. No. 3,706,561; the iodide disclosed in JP-A-58-16235, the polyethyleneoxides disclosed in West German patent 2,748,430 and the polyamine compounds disclosed in JP-B-45-8836, can be used as bleach accelerators of this type. The mercapto compounds such as those disclosed in British Patent 1,138,842 are especially desirable.

The amount of bleaching accelerator used is from 0.01 to 20 grams, and preferably from 0.1 to 10 grams, per liter of liquid which has a bleaching capacity.

Sulfite ion releasing compounds, such as sulfites (for example, sodium sulfite, potassium sulfite, ammonium sulfite), bisulfites (for example, ammonium bisulfite, sodium bisulfite, potassium bisulfite) and metabisulfites (for example, potassium metabisulfite, sodium metabisulfite, ammonium metabisulfite) for example, may be included as preservatives in a bleach-fixer in the present invention in addition to the aforementioned compounds of formulae (I), (II), (A), (B), (C) and (D).

Ascorbic acid, for example, can also be added.

Buffers, fluorescent whiteners, chelating agents, anti-foaming agents and fungicides, for example, may also be added, as desired.

The replenishment rate of the bleach-fixer of the present invention is preferably from 30 ml to 1000 ml, and most desirably from 40 ml to 350 ml, per square meter of photographic material. Furthermore, the processing temperature is from 25° C. to 50° C., and preferably from 30° C. to 40° C.

Aeration or jet agitation, for example, can be used as desired.

The silver halide color photographic materials with which the present invention is used are generally subjected to a water washing process and/or stabilization process after the de-silvering bleach-fixing process.

The amount of wash water used in a washing process can be fixed within a wide range, depending on the characteristics (depending on the materials such as couplers which have been used, for example) and the application of the photographic material, and the wash water temperature, the number of water washing tanks (the number of water washing stages), the replenishment system, i.e. whether a counter-flow or sequential flow system is used, and various other factors. In this connection, the relationship between the amount of water used and the number of washing tanks in a multi-stage counter-flow system can be obtained using the method outlined on pages 248–253 of the *Journal of the Society of Motion Picture and Television Engineers,* Vol. 64 (May, 1955). In general, the number of stages in a multi-stage counter-current system is preferably from 2 to 6, and most desirably it is from 2 to 4.

The amount of wash water can be greatly reduced by using a multi-stage counter-flow system, and washing can be achieved with from 0.5 to 1 liter of water per square meter of photographic material, for example, and the effect of the present invention is pronounced. However, bacteria proliferate due to the increased residence time of the water in the tanks and problems arise with the suspended matter which is produced becoming attached to the photographic material, for example. The method in which the calcium ion and magnesium ion concentrations are reduced, as disclosed in JP-A-62-288838, can be used very effectively as a means of overcoming these problems when processing color photographic materials in the present invention. Furthermore, use can also be made of the isothiazolone compounds and thiabendazoles disclosed in JP-A-57-8542, the chlorine based disinfectants such as chlorinated sodium isocyanurate disclosed in JP-A-61-120145, the benzotriazole disclosed in JP-A-61-267761, copper ions, and the disinfectants disclosed in Bokin Bobai no Kagaku (The Chemistry of Biocides and Fungicides) by Horiguchi, in Biseibutsu no Mekkin, Sakkin, Bobai Gijutsu (Killing Micro-organisms, Biocidal and Fungicidal Techniques) published by the Health and Hygiene Technical Society, and in Bokin Bobaizai Jiten (*A Dictionary of Biocides and Fungicides*) published by the Japanese Biocide and Fungicide Society (1986).

Moreover, surfactants can be used in the washing water as draining agents, and chelating agents as typified by EDTA can be used as hard water softening agents.

A direct stabilization process can be carried out following, or in place of, the above mentioned water washing process. Compounds which have an image stabilizing function and aldehydes as typified by formalin, for example, buffers for adjusting the film pH to a level which is suitable for providing dye stability, and ammonium compounds can be added to the stabilizer. Furthermore, the aforementioned biocides and fungicides can be used to prevent the proliferation of bacteria in the liquid and to provide the processed photographic material with biocidal properties.

Moreover, surfactants, fluorescent whiteners and film hardening agents can also be added. All of the known methods disclosed, for example, in JP-A-57-8543, JP-A-58-14834 and JP-A-60-220345 can be used in those cases where, in the processing of photographic materials of the present invention, stabilization is carried out directly without carrying out a water washing process.

Those stabilizers in which chelating agents, such as 1-hydroxyethylidene-1,1-diphosphonic acid or ethylenediamine tetramethylenephosphonic acid, for example, and magnesium and bismuth compounds, are used are also preferred embodiments.

The so-called rinse baths are used in the same way as the water wash baths or stabilizing baths which are used after the de-silvering process in the present invention.

The pH value in the water washing process or stabilizing process of the present invention is from 4 to 10, and preferably from 5 to 8. The temperature can be set variously in accordance with the application and characteristics of the photographic material but, in general, the temperature is from 15° C. to 45° C., and preferably from 20° C. to 40° C. The process time can be set optionally, but the effect of the present invention is more pronounced with shorter process times and a time of from 30 seconds to 2 minutes is preferred while a processing time of from 15 seconds to 1 minute 30 seconds is most desirable. A low replenishment rate is preferred from the viewpoints of the running costs, reducing the amount of effluent and handling characteristics etc., and the effect of the invention is also greater.

In practical terms, the preferred replenishment rate is from 3 to 50 times, and most desirably from 5 to 40 times, the amount of carry-over from the previous bath per unit area of photographic material. Furthermore, it is not more than 1 liter, and preferably not more than 500 ml, per square meter of photographic material. Furthermore, replenishment can be carried out either continuously or intermittently.

The liquid which has been used in the water washing and/or stabilizing processes can, moreover, be used in the preceding processes. As an example, the reduced washing water overflow obtained using a multi-stage counter-flow system can be fed into the preceding bleach-fix bath and the bleach-fixer can be replenished using a concentrated liquid, and the amount of effluent can be reduced in this way.

The total processing time of the de-silvering process and the final bath (water washing or stabilization) process in the present invention is preferably not more than 3 minutes, and most desirably from 30 seconds to 2 minutes 30 seconds. Here, the term "total time" signifies the interval from the time at which the silver halide color photographic material makes contact with the initial bath of the de-silvering process up to the time at which it emerges from the final bath of the final bath process. In the present invention, the in-air time for transfers en route is included. The present invention has a profound effect on problems such as edge permeation, for example. Even under such rapid processing conditions, these problems are more effectively eliminated by the conjoint use of compounds of formula (I) or (II) and bisulfite adducts of compounds of formulae (A) to (D), as described earlier.

The method of the present invention can be applied to any processing steps. For example, it can be applied to the processing of color papers, color reversal papers, color direct positive light-sensitive materials, color positive films, color negative films and color reversal films. Furthermore, it is preferably applied to color papers and color reversal papers.

The silver halide color photographic materials which are processed in the present invention are described in detail below.

Various color couplers must be included in the photographic material which is to be processed in accordance with the present invention. Here, the term "color coupler" signifies a compound which undergoes a coupling reaction with the oxidized form of a primary aromatic amine developing agent and forms a dye. Naphthol and phenol based compounds, pyrazolone and pyrazoloazole based compounds, and staight chain or heterocyclic ketomethylene compounds are typical examples of useful color couplers. Actual examples of the cyan, magenta and yellow couplers which can be used in the present invention have been disclosed in the patents cited in *Research Disclosure* (RD) 17643 (December, 1978) section VII-D, and *Research Disclosure* 18717 (November, 1979).

The color couplers which are incorporated into the photographic materials are preferably rendered fast to diffusion by having ballast groups or by polymerization. Two-equivalent color couplers which are substituted with a leaving group at the active coupling position enable the amount of silver coated to be reduced relative to that required with a four-equivalent coupler which has a hydrogen atom at the active coupling position, and the effect of the present invention is increased and this is desirable. Couplers of which the colored dye has a suitable degree of diffusibility, non-color forming couplers or DIR couplers which release development inhibitors as the coupling reaction proceeds, or couplers which release development accelerators as the coupling reaction proceeds, can also be used.

The oil protected type acylacetamide based couplers are typical of the yellow couplers which can be used in the present invention. Actual examples have been disclosed, for example, in U.S. Pat. Nos. 2,407,210, 2,875,057 and 3,265,506. The use of two-equivalent yellow couplers is preferred in the present invention, and typical examples include the oxygen atom elimination type yellow couplers disclosed, for example, in U.S. Pat. Nos. 3,408,194, 3,447,928, 3,933,501 and 4,022,620, and the nitrogen atom elimination type yellow couplers disclosed, for example, in JP-B-58-10739, U.S. Pat. Nos. 4,401,752 and 4,326,024, RD 18053 (April, 1979), British Patent 1,425,020, and West German Patent Applications (OLS) 2,219,917, 2,261,361, 2,329,587 and 2,433,812. Moreover, α-pivaloylacetanilide based couplers provide dyes which have excellent fastness, especially light fastness, while α-benzoylacetanilde based couplers provide high color densities.

Oil protected type indazolone based or cyanoacetyl based, and preferably 5-pyrazolone based and pyrazoloazole based couplers, such as pyrazolotriazoles for example, are preferred as the magenta couplers which are used in the present invention. The 5-pyrazolone based couplers which have an arylamino group or an acylamino group substituted in the 3-position are preferred from the point of view of the hue of the dye which is formed and the color density, and typical examples have been disclosed, for example, in U.S. Pat. Nos. 2,311,082, 2,343,703, 2,600,788, 2,908,573, 3,062,653, 3,152,896 and 3,936,015. The nitrogen atom leaving groups disclosed in U.S. Pat. No. 4,310,619 or the arylthio groups disclosed in U.S. Pat. No. 4,351,897 are the preferred leaving groups for the two-equivalent 5-pyrazolone based couplers. Furthermore, the 5-pyrazolone based couplers which have ballast groups disclosed in European Patent 73,636 provide high color densities.

The pyrazolobenzimidazoles disclosed in U.S. Pat. No. 3,369,879, and preferably the pyrazolo[5,1-c][1,2,4]triazoles disclosed in U.S. Pat. No. 3,725,067, the pyrazolotetrazoles disclosed in *Research Disclosure* 24220 (June, 1984) and the pyrazolopyrazoles disclosed in *Research Disclosure* 24230 (June, 1984) are preferred as pyrazoloazole based couplers. The imidazo[1,2-b]pyrazoles disclosed in European Patent 119,741 are preferred in view of the slight absorbance on the yellow side and the light fastness of the colored dye, and the pyrazolo[1,5-b][1,2,4]triazoles disclosed in European Patent 119,860 are especially desirable.

The oil protected type naphthol based and phenol based couplers can be used as cyan couplers in the present invention, and typical examples include the naphthol based couplers disclosed in U.S. Pat. No. 2,474,293 and, preferably, the oxygen atom elimination type two-equivalent naphthol based couplers disclosed in U.S. Pat. Nos. 4,052,212, 4,146,396, 4,228,233 and 4,296,200. Furthermore, actual examples of phenol based couplers have been disclosed, for example, in U.S. Pat. Nos. 2,369,929, 2,801,171, 2,772,162 and 2,895,826. The use of cyan couplers which are fast to moisture and temperature is preferred in the present invention, and typical examples of such couplers include the phenol based cyan couplers which have alkyl groups comprising an ethyl or larger group in the meta position of the phenol ring disclosed in U.S. Pat. No. 3,772,002, the 2,5-diacylamino substituted phenol based couplers disclosed, for example, in U.S. Pat. Nos. 2,772,162, 3,758,308, 4,126,396, 4,334,011 and 4,327,173, West German Patent Application (OLS) 3,329,729, and JP-A-59-166956, and the phenol based couplers which have a phenylureido group in the 2-position and an acylamino group in the 5-position disclosed, for example, in U.S. Pat. Nos. 3,446,622, 4,333,999, 4,451,559 and 4,427,767.

The dye forming couplers and the above mentioned special couplers may take the form of dimers or larger polymers. Typical examples of polymerized dye forming couplers have been disclosed in U.S. Pat. Nos. 3,451,820 and 4,080,211. Actual examples of polymerized magenta couplers have been disclosed in British Patent 2,102,173 and U.S. Pat. No. 4,367,282.

Two or more of the various types of coupler used in the present invention can be used conjointly in the same layer of the photographic layer, and the same compound can be used in two or more different layers, in order to satisfy the characteristics required of the photographic material.

The standard amount of color coupler used is within the range from 0,001 to 1 mol per mol of light-sensitive silver halide, and the preferred amount is within the range from 0.01 to 0.5 mol per mol of light-sensitive silver halide in the case of the yellow couplers, within the range from 0.03 to 0.3 mol per mol of light-sensitive silver halide in the case of the magenta couplers and within the range from 0.002 to 0.3 mol per mol of light-sensitive silver halide in the case of the cyan couplers.

The couplers used in the present invention can be introduced into the photographic materials using various known methods of dispersion. Examples of high boiling point organic solvents which can be used in the oil in water dispersion method have been disclosed, for example, in U.S. Pat. No. 2,322,027. Furthermore, actual examples of the processes and effects of the latex dispersion method, and of latexes for loading purposes, have been disclosed in U.S. Pat. No. 4,199,363 and West German Patent Applications (OLS) 2,541,274 and 2,541,230.

The silver halide emulsions of the photographic materials used in the present invention can have any halogen composition, such as silver iodobromide, silver bromide, silver chlorobromide or silver chloride. For example, in cases where rapid processing or low-replenishment rate processing are to be carried out, such as with color papers, the use of a silver chloride emulsion or a silver chloro-bromide emulsion which contains at least 60 mol % of silver chloride is preferred, and emulsions in which the silver chloride content is from 80 to 100 mol % are especially desirable. Furthermore, in cases where it is necessary to suppress fogging during the manufacture, storage and/or photographic processing to a particularly low level, the use of silver chlorobromide emulsion which contain at least 50 mol % of silver bromide, or silver bromide emulsions (which may contain not more than 3 mol % of silver iodide) are preferred, and those which contain at least 70 mol % of silver bromide are especially desirable. Silver iodobromide and silver chloroiodobromide are preferred in color photographic materials for general photography, and here a silver iodide content of from 3 to 15 mol % is preferred.

The silver halide grains used in the present invention may be such that the interior and surface layers consist of different layers, or they may have a multi-layer structure which has a junction structure, or they may be such that the whole grain consists of a uniform phase. Furthermore, they may be comprised of a mixture of such grains.

The average grains size distribution of the silver halide grains used in the present invention may be narrow or wide, but the use of so-called mono-disperse silver halide emulsions in which the value (variation coefficient) obtained by dividing the standard deviation of the grain size distribution curve for the silver halide emulsion by the average grain size is within 20%, and preferably within 15%, is desirable in the present invention. Furthermore, two or more types of mono-disperse silver halide emulsion (which preferably have variation coefficients as indicated above in respect of their mono-dispersivity) can be mixed in the same layer, or lamination coated as separate layers, in emulsion layers which have essentially the same color sensitivity in order to ensure that the photographic materials has the desired gradation. Moreover, mixtures or laminations of combinations of two or more types of poly-disperse silver halide emulsion, or of mono-disperse emulsions and poly-disperse emulsions can also be used.

The form of the silver halide grains used in the present invention may be a regular crystalline form, such as a cubic, octahedral, rhombododecahedral or tetradecahedral form, for example, or a crystalline form in which such regular forms are present together, or it may be an irregular crystalline form such as a spherical form, or it may be a composite crystalline form consisting of these crystalline forms. Furthermore, the grains may be tabular gains, and use can be made of emulsions in which tabular grains of which the value of the diameter/thickness ratio is from 5 to 8, or greater than 8, account for at least 50% of the total projected area of all the grains. The emulsions may also be comprised of mixtures of these various crystalline forms.

These various emulsions may be surface latent image type emulsions in which the latent image is formed principally on the surface, or of the internal latent image type in which the latent image is formed within the grains.

The photographic emulsions used in the present invention can be prepared using the methods disclosed in *Research Disclosure,* Volume 176, Item No. 17643 (sections I, II, III) (December, 1978).

The emulsions used in the present invention have generally been subjected to physical ripening, chemical ripening and spectral sensitization. Additives which are used in such processes have been disclosed in *Research Disclosure* volume 176, No. 17643 (December, 1979) and in *Research Disclosure* volume 187, No. 18716 (November, 1979), and the locations of these disclosures are summarized in the table below.

Known photographically useful additives which can be used in the present invention are also disclosed in the two Research Disclosures referred to above, and the locations of these disclosures are also indicated in the table below.

| Type of Additive | RD 17643 | RD 18716 |
|---|---|---|
| 1. Chemical sensitizers | Page 23 | Page 648, right col. |
| 2. Speed increasing agents | | As above |
| 3. Spectral sensitizers | Pages 23–24 | Pages 648 right col. to 649 right col. |
| 4. Super-sensitizers | | |
| 5. Whiteners | Page 24 | |
| 6. Anti-foggants & Stabilizers | Pages 24–25 | Page 649, right col. |
| 7. Couplers | Page 25 | |
| 8. Organic Solvents | Page 25 | |
| 9. Light absorbers, and filter dyes | Pages 25–26 | Pages 649, right col. to 650, left col. |
| 10. Ultraviolet absorbers | As above | As above |
| 11. Anti-staining agents | Page 25, right col. | Page 650, left–right cols. |
| 12. Dye image stabilizers | Page 25 | |
| 13. Film hardening agents | Page 26 | Page 651, left col. |
| 14. Binders | Page 26 | As above |
| 15. Plasticizers, lubricants | Page 27 | Page 650, right col. |
| 16. Coating promotors, Surfactants | Pages 26–27 | Page 650, right col. |
| 17. Anti-static agents | Page 27 | As above |

The photographic materials used in the present invention are coated onto a flexible support such as paper, for example. Supports and methods of coating have been disclosed in detail in *Research Disclosure,* volume 176, item 17643, section XV (p. 27) and section XVI (page 28) (December 1978).

The use of a reflective support is preferred in the present invention.

A "reflective support" is a support which has a high reflectivity with which the brilliance of the dye image which is formed in the silver halide emulsion layer is enhanced, and such reflective supports include those in which a support is covered with a hydrophobic resin which itself contains a dispersion of a light reflecting substance such as titanium oxide, zinc oxide, calcium carbonate or calcium sulfate for example, and those in which a hydrophobic resin which contains a dispersion of such a light reflecting substance is used for the support.

Staining of the edge parts when processing a color photographic material, and especially a color photographic material for print purposes which has a paper support, has unexpectedly been greatly reduced by the conjoint use of the aforementioned compounds of formula (I) or (II) and compounds of formula (A), (B), (C) or (D) in the bleach-fixer.

Furthermore, considerable stabilization of the bleach-fixer itself (in respect of the prevention of sulfiding) can be achieved in addition to the ability to suppress to a great extent the staining which occurs on ageing processed photographic materials.

The present invention is described in detail below by means of illustrative examples.

EXAMPLE 1

A multi-layer color printing paper (sample I) of which the layer structure is indicated below was prepared on a paper support of which both sides had been laminated with polyethylene. The coating liquids were prepared in the way described below.

Preparation of the First Layer Coating Liquid

Ethyl acetate (27.2 cc) and 8.2 grams of solvent (Solv-1) were added to 19.1 grams of yellow coupler (ExY), 4.4 grams of colored image stabilizer (Cpd-1) and 0.7 gram of colored image stabilizer (Cpd-7) to form a solution which was then emulsified and dispersed in 185 cc of a 10% aqueous gelatin solution which contained 8 cc of 10% sodium dodecylbenzenesulfonate. On the other hand, the blue-sensitive sensitizing dyes indicated below were added to a silver chlorobromide emulsion (a 3:7 (Ag mol ratio) mixture of cubic emulsions of average grain size 0.88 μm and 0.70 μm; the variation coefficients of the grain size distributions were 0.06 and 0.10, and each emulsion had 0.1 mol. % silver bromide included locally on the surface of the grains) in amounts of $3.0\times10^{-4}$ mol of each per mol of silver to the emulsion which had large grains and in amounts of $4.0\times10^{-4}$ mol of each per mol of silver halide to the emulsion which had small grains, after which the emulsion was sulfur sensitized. This emulsion was mixed with the aforementioned emulsified dispersion to prepare the first layer coating liquid of which the composition is indicated below.

The coating liquids for the second to the seventh layers were prepared using the same procedure as for the first layer coating liquid. 1-Oxy-3,5-dichloro-s-triazine, sodium salt, was used as a gelatin hardening agent in each layer in an amount of 0.015 g per 1 g of gelatin.

The spectrally sensitizing dyes indicated below were used for each layer.

Blue Sensitive Emulsion Layer

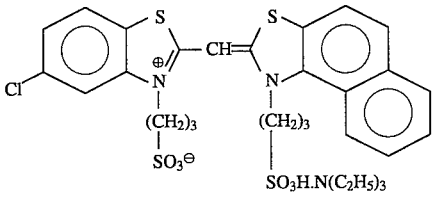

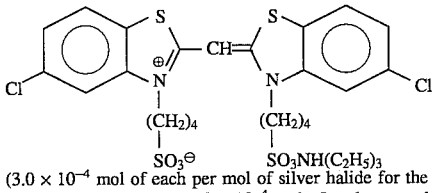

($3.0 \times 10^{-4}$ mol of each per mol of silver halide for the large size emulsion and $4.0 \times 10^{-4}$ mol of each per mol of silver halide for the small size emulsion)

Green Sensitive Layer

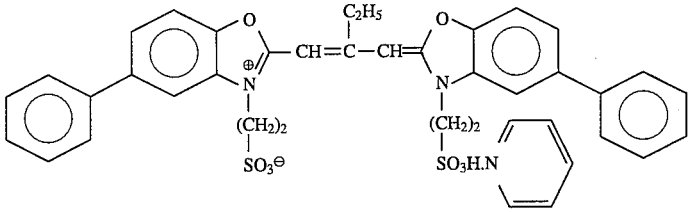

($5.0 \times 10^{-4}$ mol per mol of silver halide for the large size emulsion and $6.0 \times 10^{-4}$ mol per mol of silver halide for the small size emulsion)

and

-continued

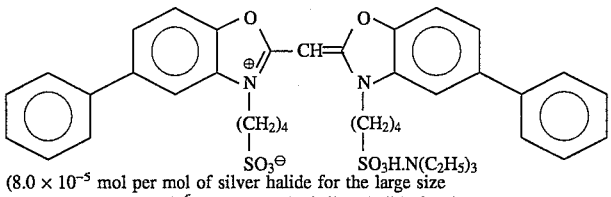

($8.0 \times 10^{-5}$ mol per mol of silver halide for the large size emulsion and $1.2 \times 10^{-5}$ mol per mol of silver halide for the small size emulsion)

Red Sensitive Layer

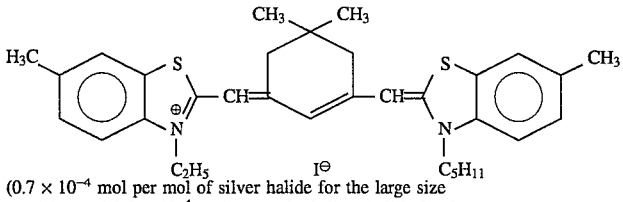

($0.7 \times 10^{-4}$ mol per mol of silver halide for the large size emulsion and $1.2 \times 10^{-4}$ mol per mol of silver halide for the small size emulsion)

The compound indicated below was added in an amount of $2.6\times10^{-3}$ mol per mol of silver halide to the red sensitive emulsion layer.

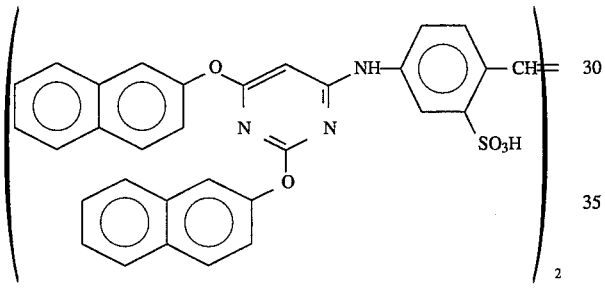

Furthermore, 1-(5-methylureidophenyl)-5-mercaptotetrazole was added to the blue, green and red sensitive emulsion layers in amounts, per mol of silver halide, of $8.5\times10^{-5}$ mol, $7.7\times10^{-4}$ mol and $2.5\times10^{-4}$ mol respectively.

Furthermore, 4-hydroxy-6-methyl-1,3,3a,7-tetra-azaindene was added to the blue and green sensitive emulsion layers in amounts, per mol of silver halide, of $1\times10^{-4}$ mol and $2\times10^{-4}$ mol respectively.

The dyes indicated below were added to the emulsion layers for anti-irradiation purposes in each amount of $4\times10^{-4}$ mol per $m^2$.

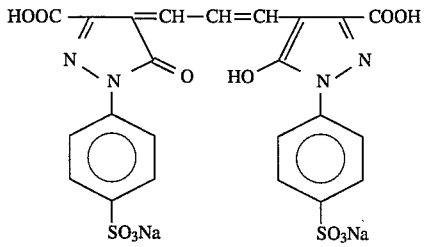

and

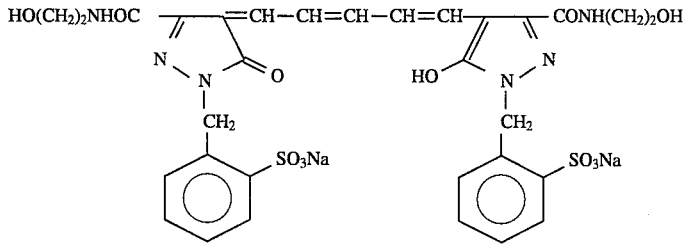

Layer Structure

The composition of each layer is indicated below. The numerical values indicate coated weights ($g/m^2$). In the case of silver halide emulsions the coated weight is shown as the calculated coated weight of silver.

Support

Polyethylene laminated paper [White pigment ($TiO_2$) and blue dye (ultramarine) were included in the polyethylene on the first layer side]

| | |
|---|---|
| First Layer (Blue Sensitive Layer) | |
| The aforementioned silver chlorobromide emulsion | 0.25 |
| Gelatin | 1.86 |
| Yellow coupler (ExY) | 0.82 |
| Colored image stabilizer (Cpd-1) | 0.19 |
| Solvent (Solv-1) | 0.35 |
| Colored image stabilizer (Cpd-7) | 0.06 |
| Second Layer (Anti-color Mixing Layer) | |
| Gelatin | 0.99 |
| Anti-color mixing agent (Cpd-5) | 0.08 |
| Solvent (Solv-1) | 0.16 |
| Solvent (Solv-4) | 0.08 |
| Third Layer (Green Sensitive Layer) | |
| Silver chlorobromide emulsion (a 1:3 (silver mol ratio) mixture of a cubic emulsions of average grain size 0.55 μm and 0.39 μm; the variation coefficients of the grain size distributions were 0.10 and 0.08, and each emulsion had 0.5 mol · % AgBr included locally at the grain surface) | 0.12 |
| Gelatin | 1.24 |
| Magenta coupler (ExM) | 0.20 |
| Colored image stabilizer (Cpd-2) | 0.03 |
| Colored image stabilizer (Cpd-3) | 0.15 |
| Colored image stabilizer (Cpd-4) | 0.02 |
| Colored image stabilizer (Cpd-9) | 0.02 |
| Solvent (Solv-2) | 0.40 |
| Fourth Layer (Ultraviolet Absorbing Layer) | |
| Gelatin | 1.58 |
| Ultraviolet absorber (UV-1) | 0.47 |
| Anti-color mixing agent (Cpd-5) | 0.05 |
| Solvent (Solv-5) | 0.24 |
| Fifth Layer (Red Sensitive Layer) | |
| Silver chlorobromide emulsion (a 1:4 (silver mol ratio) mixture of a cubic emulsions of average grain size 0.58 μm and 0.45 μm; the variation coefficients of the grain size distributions were 0.09 and 0.11, and each emulsion had 0.3 mol · % AgBr included locally at the grain surface) | 0.18 |
| Gelatin | 1.34 |
| Cyan coupler (ExC) | 0.32 |
| Colored image stabilizer (Cpd-6) | 0.17 |
| Colored image stabilizer (Cpd-7) | 0.40 |
| Colored image stabilizer (Cpd-8) | 0.04 |
| Solvent (Solv-6) | 0.15 |
| Sixth Layer (Ultraviolet Absorbing Layer) | |
| Gelatin | 0.53 |
| Ultraviolet absorber (UV-1) | 0.16 |
| Anti-color mixing agent (Cpd-5) | 0.02 |
| Solvent (Solv-5) | 0.08 |
| Seventh Layer (Protective Layer) | |
| Gelatin | 1.33 |
| Acrylic modified poly(vinyl alcohol) copolymer (17% modification) | 0.17 |
| Liquid paraffin | 0.03 |

-continued
(ExY) Yellow Coupler
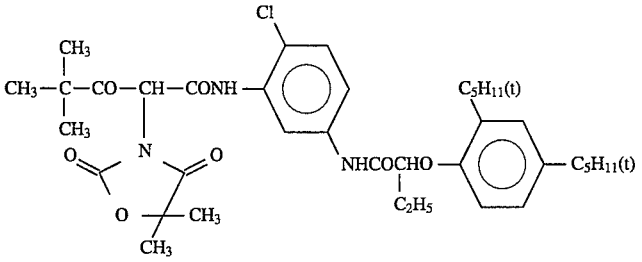
(ExM) Magenta Coupler
A 1:1 (mol ratio) mixture of
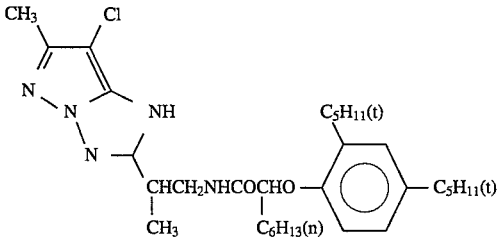
and
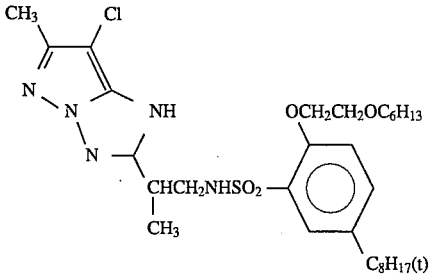
(ExC) Cyan Coupler
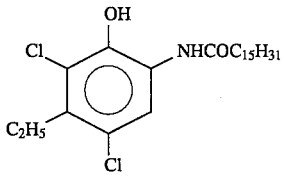
(Cpd-1) Colored Image Stabilizer
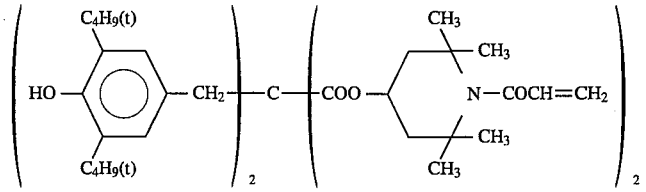
(Cpd-2) Colored Image Stabilizer
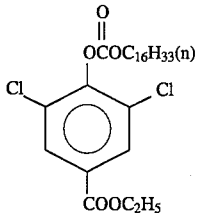

-continued
(Cpd-3) Colored Image Stabilizer
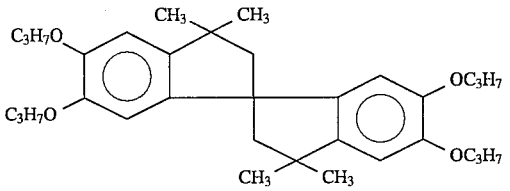
(Cpd-4) Colored Image Stabilizer
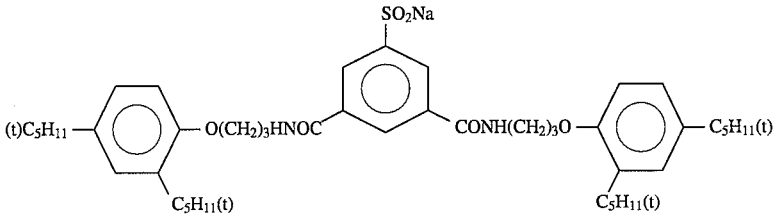
(Cpd-5) Anti-color Mixing Agent
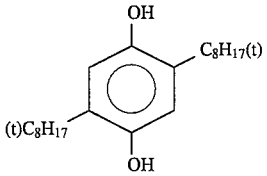
(Cpd-6) Colored Image Stabilizer
A 2:4:4 (by weight) mixture of:
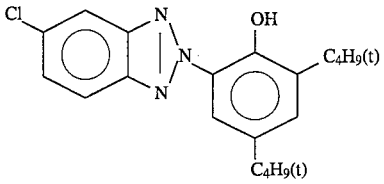
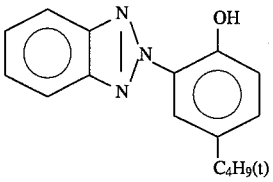
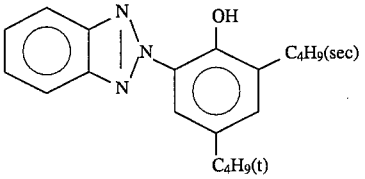
(Cpd-7) Colored Image Stabilizer
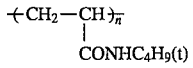
Average Molecular Weight 60,000
(Cpd-8) Colored Image Stabilizer
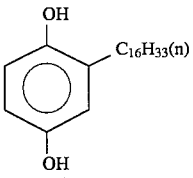

(Cpd-9) Colored Image Stabilizer
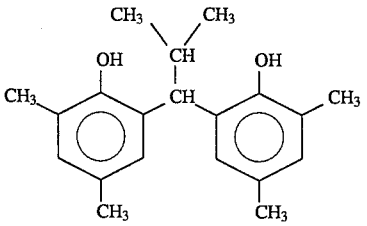
(UV-l) Ultraviolet Absorber
A 4:2:4 (by weight) mixture of:
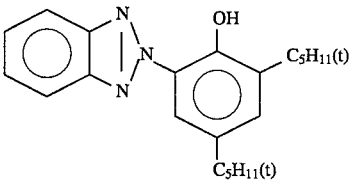
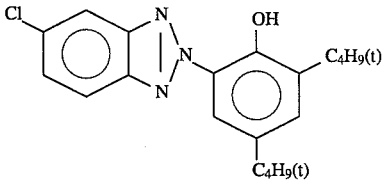
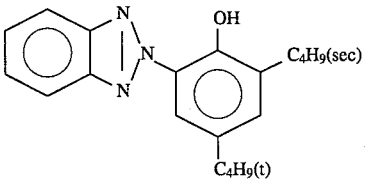
(Solv-1) Solvent
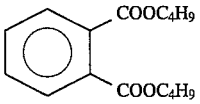
(Solv-2) Solvent
A 2:1 (by volume) mixture of:
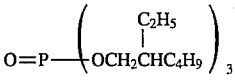
and
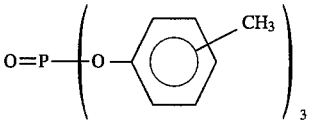
(Solv-4) Solvent
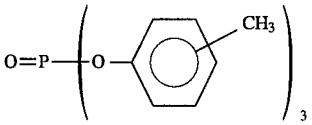

-continued (Solv-5) Solvent $$\begin{array}{l} COOC_8H_{17} \\ | \\ (CH_2)_5 \\ | \\ COOC_8H_{17} \end{array}$$

(Solv-6) Solvent

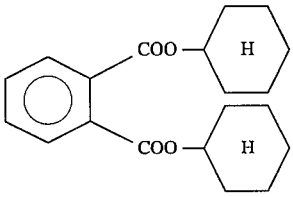

The sample I obtained in the way described above was processed in accordance with the processing steps indicated below after being subjected to a wedge exposure.

| Processing Step | Temperature | Time | Tank Capacity |
|---|---|---|---|
| Color development | 38° C. | 45 seconds | 150 liters |
| Bleach-fix | 30–36° C. | 45 seconds | 15 liters |
| Water wash (1) | 30–36° C. | 45 seconds | 7 liter |
| Water wash (2) | 30–36° C. | 45 seconds | 7 liter |
| Water wash (3) | 30–36° C. | 45 seconds | 7 liter |

Water washing with a cascade system (3)→(2)→(1)

The composition of each processing bath used was as indicated below.

| Color Developer | Tank Solution |
|---|---|
| Water | 800 ml |
| Nitrilo-N,N,N-trimethylenephosphonic acid (40%) | 8 grams |
| 1-Hydroxyethylidene-1,1-diphosphonic acid (60%) | 0.6 gram |
| Diethylenetriamine penta-acetic acid | 0.5 gram |
| Compound I-7 | 5.0 grams |
| Triethanolamine | 8.0 grams |
| Sodium chloride | 2.8 grams |
| Potassium bromide | 0.015 grams |
| Potassium carbonate | 25 grams |
| N-Ethyl-N-(β-methanesulfonamido-ethyl)-3-methyl-4-aminoaniline sulfate | 5.0 grams |
| Fluorescent whitener (Whitex-4, Sumitomo Chemical Co.) | 1.5 grams |

-continued

| Color Developer | Tank Solution |
|---|---|
| Water to make up to 1 liter | pH 10.05 |

Bleach-fixer

The composition, as indicated below, was varied in the way shown in Table 1.

| | |
|---|---|
| Water | 500 ml |
| Ammonium thiosulfate (70%) | 110 ml |
| Ammonium sulfite | 0.2 mol |
| Ethylenediamine tetra-acetic acid, ferric ammonium salt | 50 grams |
| Ethylenediamine tetra-acetic acid | 3 grams |
| Sulfuric acid | 15 grams |
| Additive | See Table 1 |
| Water to make up to 1 liter | pH 5.50 |

Wash Water

Ion exchanged water with calcium ion and magnesium ion both less than 5 ppm.

Each bleach-fixer was aged at room temperature in a 100 ml open beaker and the number of days prior to sulfiding was observed visually.

Furthermore, the processed samples were left to stand for 15 days under conditions of 80° C./60% RH and the increase in magenta density in the unexposed parts was measured.

Furthermore, at the same time 30 processed samples were placed one on top of another and left to stand for 7 days at 80° C./70% RH and the increase in yellow density of the edge part (edge staining) was measured.

The results obtained are shown in Table 1.

TABLE 1

| | Additive | | | Results | | |
|---|---|---|---|---|---|---|
| No. | (I), (II) (0.02 mol/l) | (A)(B)(C)(D) (0.2 mol/l) | Remarks | Days to Sulfiding | Increase in Staining | Edge Staining |
| 1 | — | — | Comparative Example | 19 days | +0.08 | +0.18 |
| 2 | — | A-1 | Comparative Example | 31 days | +0.12 | +0.24 |
| 3 | — | A-27 | Comparative Example | 25 days | +0.16 | +0.27 |
| 4 | — | A-32 | Comparative Example | 25 days | +0.17 | +0.28 |
| 5 | — | B-4 | Comparative | 21 days | +0.15 | +0.25 |

TABLE 1-continued

| No. | Additive (I), (II) (0.02 mol/l) | Additive (A)(B)(C)(D) (0.2 mol/l) | Remarks | Results Days to Sulfiding | Results Increase in Staining | Results Edge Staining |
|---|---|---|---|---|---|---|
| 6 | — | C-6 | Example Comparative Example | 22 days | +0.16 | +0.25 |
| 7 | — | C-9 | Comparative Example | 22 days | +0.16 | +0.26 |
| 8 | — | D-1 | Comparative Example | 27 days | +0.15 | +0.25 |
| 9 | — | D-4 | Comparative Example | 23 days | +0.15 | +0.26 |
| 10 | I-2 | — | Comparative Example | 20 days | +0.08 | +0.18 |
| 11 | I-7 | — | Comparative Example | 20 days | +0.09 | +0.19 |
| 12 | I-14 | — | Comparative Example | 20 days | +0.09 | +0.18 |
| 13 | II-7 | — | Comparative Example | 19 days | +0.08 | +0.18 |
| 14 | II-28 | — | Comparative Example | 19 days | +0.08 | +0.19 |
| 15 | I-7 | A-1 | Present Invention | 45 days | +0.07 | +0.17 |
| 16 | I-7 | A-27 | Present Invention | 36 days | +0.07 | +0.19 |
| 17 | I-7 | A-32 | Present Invention | 38 days | +0.08 | +0.19 |
| 18 | I-7 | B-4 | Present Invention | 29 days | +0.08 | +0.19 |
| 19 | I-2 | C-6 | Present Invention | 31 days | +0.08 | +0.19 |
| 20 | I-14 | C-9 | Present Invention | 30 days | +0.08 | +0.19 |
| 21 | II-7 | D-1 | Present Invention | 33 days | +0.08 | +0.20 |
| 22 | II-28 | D-4 | Present Invention | 31 days | +0.09 | +0.19 |

Little effect was obtained when compounds represented by formula (I) or (II) were added individually (Nos. 10 to 14), while the addition of compounds represented by formulae (A), (B), (C) and (D) rendered sulfiding less likely to occur but gave rise to increased staining and edge staining occurred (Nos. 2 to 9). However, when compounds of formula (I) or (II) and compounds of formula (A), (B), (C) or (D) were used conjointly there was a marked improvement in the stability of the blix bath and, at the same time, the problems with increased staining and edge staining were eliminated.

EXAMPLE 2

Color printingpaper sample II-A was prepared by the sequential coating of the first (lowermost) to the seventh (uppermost) layers, as shown in Table 2, onto a paper support which had been laminated on both sides with polyethylene and which had been subjected to a corona discharge treatment. The coating liquids for each layer were prepared in the way indicated below. Moreover, details such as the structural formulae of the couplers and dye stabilizers etc. used in the coating liquids are indicated hereinafter.

The first layer coating liquid was prepared in the following way. Thus, a mixture obtained by adding 600 ml of ethyl acetate as an auxiliary solvent to 200 grams of yellow coupler, 93.3 grams of anti-color mixing agent, 10 grams of high boiling point solvent (p) and 5 grams of solvent (q) was heated to 60° C. to form a solution which was mixed with 3330 ml of 5% aqueous gelatin solution which contained 330 ml of a 5% aqueous solution of "Alkanol B" (trade name, an alkylnaphthalene sulfonate, made by the DuPont Co.). Next, this liquid mixture was emulsified using a colloid mill and a coupler dispersion was obtained. The ethyl acetate was removed from this dispersion by distillation under reduced pressure and a coating liquid was prepared by adding this to 1,400 grams of an emulsion (96.7 grams as Ag, 170 grams gelatin) to which a sensitizing dye for blue sensitive emulsion layer purposes and 1-methyl-2-mercapto-5 -acetylamino-1,3,4-triazole had been added, and then adding a further 2,600 grams of a 10% aqueous gelatin solution. The coating liquids for the second to the seventh layer were prepared on the same basis as the first layer coating liquid in accordance with the composition shown in Table 2.

TABLE 2

| Layer | Composition | | |
|---|---|---|---|
| Seventh Layer (Protective Layer) | Gelatin | | 600 mg/m$^2$ |
| Sixth Layer (Ultraviolet Absorbing Layer) | Ultraviolet Absorber | (n) | 260 mg/m$^2$ |
| | Ultraviolet absorber | (o) | 70 mg/m$^2$ |
| | Solvent | (p) | 300 mg/m$^2$ |
| | Solvent | (q) | 100 mg/m$^2$ |
| | Gelatin | | 700 mg/m$^2$ |
| Fifth Layer (Red Sensitive Layer) | Silver chlorobromide emulsion (99 mol · % AgCl) | | 210 mg/m$^2$ |
| | Cyan coupler | | $5 \times 10^{-4}$ mol/m$^2$ |
| | Anti-color mixing agent | (r) | 250 mg/m$^2$ |
| | Solvent | (p) | 160 mg/m$^2$ |
| | Solvent | (q) | 100 mg/m$^2$ |
| | Gelatin | | 1800 mg/m$^2$ |
| Fourth Layer (Anti-color Mixing Layer) | Anti-color mixing agent | (s) | 65 mg/m$^2$ |
| | Ultraviolet absorber | (n) | 450 mg/m$^2$ |
| | Ultraviolet absorber | (o) | 230 mg/m$^2$ |
| | Solvent | (p) | 50 mg/m$^2$ |
| | Solvent | (q) | 50 mg/m$^2$ |
| | Gelatin | | 1700 mg/m$^2$ |
| Third Layer (Green Sensitive Layer) | Silver chlorobromide emulsion (99 mol · % AgCl) | | 305 mg/m$^2$ |
| | Magenta coupler | | 670 mg/m$^2$ |
| | Anti-color mixing agent | (t) | 150 mg/m$^2$ |
| | Anti-color mixing agent | (u) | 10 mg/m$^2$ |
| | Solvent | (p) | 200 mg/m$^2$ |
| | Solvent | (q) | 10 mg/m$^2$ |
| | Gelatin | | 1400 mg/m$^2$ |
| Second Layer (Anti-color Mixing Layer) | Silver bromide emulsion (No post ripening, grain size 0.05 μm) | | as silver 10 mg/m$^2$ |
| | Anti-color Mixing Agent | (s) | 55 mg/m$^2$ |
| | Solvent | (p) | 30 mg/m$^2$ |
| | Solvent | (g) | 15 mg/m$^2$ |
| | Gelatin | | 800 mg/m$^2$ |
| First Layer (Blue Sensitive Layer) | Silver chlorobromide emulsion (99 mol · % AgCl) | | 290 mg/m$^2$ |
| | Yellow coupler | | 600 mg/m$^2$ |
| | Anti-color mixing agent | (r) | 280 mg/m$^2$ |
| | Solvent | (p) | 30 mg/m$^2$ |
| | Solvent | (q) | 15 mg/m$^2$ |
| | Gelatin | | 1800 mg/m$^2$ |
| Support | A paper support laminated on both sides with polyethylene | | |

(n) 2-(2-Hydroxy-3,5-di-tert-amylphenyl)benzotriazole
(o) 2-(2-Hydroxy-3,5-di-tert-butylphenyl)benzotriazole
(p) Di(2-ethylhexyl)phthalate
(q) Dibutyl phthalate
(r) 2,5-Di-tert-amylphenyl 3,5-di-tert-butylhydroxybenzoate
(s) 2,5-Di-tert-octylhydroquinone
(t) 1,4-Di-tert-amyl-2,5-dioctyloxybenzene
(u) 2,2'-Methylenebis(4-methyl-6-tert-butylphenol)

The substances indicated below were used as sensitizing dyes for each emulsion layer.

Blue Sensitive Emulsion Layer

Anhydro-5-methoxy-5'-methyl-3,3'-disulfopropylselenacyanine hydroxide

Green Sensitive Emulsion Layer

Anhydro-9-ethyl-5,5'-diphenyl-3,3'-disulfoethyloxacarbocyanine hydroxide

Red Sensitive Emulsion Layer 3,3'-Diethyl-5-methoxy-9,9'-(2,2-dimethyl-1,3-propano)thiadicarbocyanine iodide The substance indicated below was also used as a stabilizer in each emulsion layer.

1-Methyl-2-mercapto-5-acetylamino-1,3,4-triazole

Furthermore, the substances indicated below were used as anti-irradiation dyes.

4-(3-(Carboxy-5-hydroxy-4-(3-(3-carboxy-5-oxo-1-(4-sulfonatophenyl)-2-pyrazolin-4-ylidene)-1-propyl)-1-pyrazolyl)benzenesulfonate, di-potassium salt N,N'-(4,8-Dihydroxy-9,10-dioxo-3,7-disulfonatoanthracene-1,5-diyl)bis(aminomethanesulfonate, tetra-sodium salt Furthermore, 1,2-bis(vinylsulfonyl)ethane was used as a film hardening agent. The couplers used were as follows:

Yellow Coupler

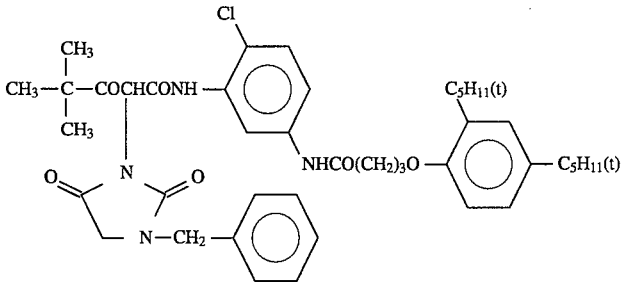

Magenta Coupler

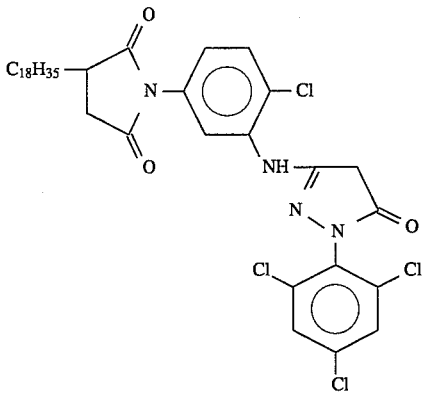

Cyan Couplers

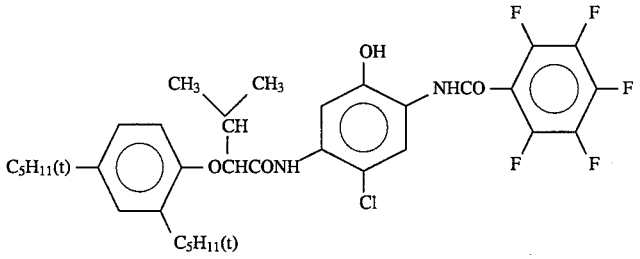

and

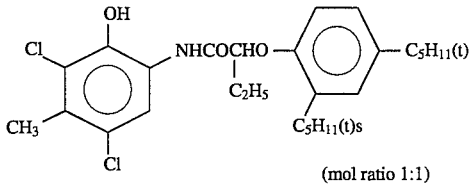

(mol ratio 1:1)

The above mentioned photographic material II-A was subjected to an imagewise exposure and processed continuously (in a running test) using a paper processor in accordance with the processing steps indicated below until the color developer had been replenished to twice the tank capacity.

| Processing Step | Temperature (°C.) | Time (sec.) | Replenisher * | Tank Capacity |
|---|---|---|---|---|
| Color Development | 38 | 45 | 100 ml | 17 liters |
| Bleach-fix | 30–36 | 45 | 60 ml | 17 liters |
| Stabilization (1) | 30–37 | 20 | — | 10 liters |
| Stabilization (2) | 30–37 | 20 | — | 10 liters |

-continued

| Processing Step | Temperature (°C.) | Time (sec.) | Replenisher * | Tank Capacity |
|---|---|---|---|---|
| Stabilization (3) | 30–37 | 20 | — | 10 liters |
| Stabilization (4) | 30–37 | 30 | 248 ml | 10 liters |
| Drying | 70–85 | 60 | | |

*: Replenishment rate per square meter of photographic material.

(A counter flow system from stabilization (4)→Stabilization (1) was used)

The compositions of the color developer and the bleach-fix were modified in the way indicated below and running tests were carried out.

The composition of each processing bath was as indicated below.

| Color Development Bath | Tank Solution | Replenisher |
|---|---|---|
| Water | 800 ml | 800 ml |
| Ethylenediamine tetra-acetic acid | 2.0 grams | 2.0 grams |
| 5,6-Dihydroxybenzene-1,2,4-trisulfonic acid | 0.3 gram | 0.3 gram |
| Triethanolamine | 8.0 grams | 8.0 grams |
| Sodium chloride | 3.5 grams | — |
| Potassium carbonate | 25 grams | 25 grams |
| N-Ethyl-N-(β-methanesulfonamido-ethyl)-3-methyl-4-aminoaniline sulfate | 5.0 grams | 10.0 grams |
| Preservative (See below) | 0.05 mol | 0.07 mol |
| Fluorescent whitener (4,4'-diaminostilbene based) | 2.0 grams | 2.5 grams |
| Water to make up to | 1000 ml | 1000 ml |
| pH (25° C.) | 10.05 | 10.65 |

| | | |
|---|---|---|
| Color Developer A | As Preservative: | Hydroxylamine sulfate |
| Color Developer B | As preservative: | I-7 |
| Color Developer C | As Preservative: | I-53 |
| Color Developer D | As Preservative: | II-7 |

-continued

| Bleach Fixer | Tank Solution | Replenisher |
|---|---|---|
| Water | 400 ml | 400 ml |
| Ammonium thiosulfate (70%) | 100 ml | 200 ml |
| Sodium sulfite | 17 grams | 34 grams |
| Ethylenediamine tetra-acetic acid, ferric ammonium salt | 55 grams | 110 grams |
| Ethylenediamine tetra—acetic acid, di-sodium salt | 5 grams | 10 grams |
| Glacial acetic acid | 9 grams | 15 grams |
| Additive | 0.13 mol | 0.26 mol |
| Water to make up to | 1000 ml | 1000 ml |
| pH (25° C.) | 5.40 | 4.50 |

-continued

| | |
|---|---|
| Bleach-fixer A | No additive |
| Bleach-fixer B | A-1 |
| Bleach-fixer C | D-3 |

| Stabilizer (Parent Bath = Replenisher) | |
|---|---|
| 1-Hydroxyethylidene-1,1-diphosphonic acid (60%) | 1.5 grams |
| Aqueous ammonia (28%) | 1.5 ml |
| 5-Chloro-2-methyl-4-isothiazolin-3-one | 0.02 gram |
| 2-Methyl-4-isothiazolin-3-one | 0.01 gram |
| Nitrilo-N,N,N-trimethylenephosphonic acid | 1.5 grams |
| Water to make up to | 1000 ml |
| pH (25° C.) | 7.0 |

Sample 2-A was processed in an unexposed state in the twelve types of running baths described above and the samples were evaluated in respect of increased staining after processing and edge staining in the same way as described in Example 1.

Furthermore, each bleach-fixer from the running tests was introduced into a 100 ml beaker and the number of days before sulfiding occurred was obtained in the same way as in Example 1.

The results obtained are shown in Table 3.

TABLE 3

| No. | Processing Bath: Color Developer | Processing Bath: Bleach-Fixer | Remarks | Number of Days before Sulfiding | Increase in Staining | Edge Staining |
|---|---|---|---|---|---|---|
| 1 | A | A | Comparative Example | 13 | +0.16 | +0.20 |
| 2 | A | B | Comparative Example | 20 | +0.25 | +0.29 |
| 3 | A | C | Comparative Example | 18 | +0.25 | +0.28 |
| 4 | B | A | Comparative Example | 13 | +0.16 | +0.20 |
| 5 | B | B | Present Invention | 38 | +0.13 | +0.15 |
| 6 | B | C | Present Invention | 33 | +0.13 | +0.15 |
| 7 | C | A | Comparative Example | 13 | +0.17 | +0.20 |
| 8 | C | B | Present Invention | 36 | +0.14 | +0.16 |
| 9 | C | C | Present Invention | 32 | +0.13 | +0.15 |
| 10 | D | A | Comparative Example | 13 | +0.17 | +0.21 |
| 11 | D | B | Present Invention | 35 | +0.14 | +0.16 |
| 12 | D | C | Present Invention | 31 | +0.13 | +0.15 |

The result of the carry-over of compounds represented by formula (I) or (II) from the color development bath which is the pre-bath was such that the bleach-fixer became a bleach-fixer of this present invention, (Nos. 5, 6, 8, 9, 11 and 12) there was an improvement in respect of increased staining and edge staining and a pronounced improvement in bleach-fixer stability was also obtained.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising color developing and bleach-fixing said photographic material, wherein said bleach-fixing step is performed with a bleach-fixer comprising:

(1) thiosulfate, (2) at least one compound represented by formula (I) indicated below, (3) an adduct of bisulfite with at least one type of compound selected from the group consisting of compounds represented by formulae (A), (B), (C) and (D) indicated below, and (4) a bleaching agent; wherein compounds of formula (I) are represented by the following:

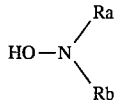

(I)

wherein Ra and Rb each independently represents a hydrogen atom, an alkyl group, an alkenyl group, an aryl group or a heterocyclic group, provided that Ra and Rb are not both at the same time hydrogen atoms;

compounds of formula (A) are represented by the following:

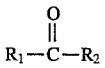

(A)

wherein $R_1$ represents a hydrogen atom, an alkyl group, an aryl group or a heterocyclic group, and $R_2$ represents an alkyl group, an aryl group or a heterocyclic group, provided that $R_1$ and $R_2$ do not combine to form a ring;

compounds of formula (B) are represented by the following:

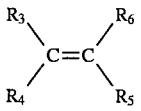

(B)

wherein $R_3$, $R_4$ and $R_5$ each independently represents a hydrogen atom, an alkyl group, an alkenyl group, an aralkyl group, a cycloalkyl group, an aryl group, a heterocyclic group, a carboxylic acid group, an ester group, an acyl group, a halogen atom, an ether group, sulfo groups or salts thereof, a sulfinyl group, a sulfonyl group, a cyano group, a nitro group, a carbamoyl group or a sulfamoyl group, and $R_6$ represents an electron attractive group selected from the group consisting of a nitro group, a cyano group, a sulfonyl group and an acyl group;

compounds of formula (C) are selected from the group consisting of:

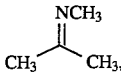

C-1

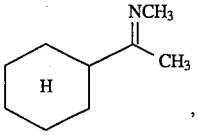

C-2

-continued

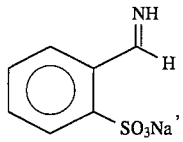

C-3

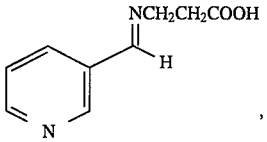

C-4

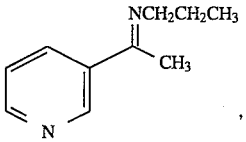

C-5

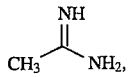

C-6

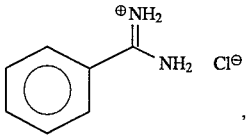

C-7

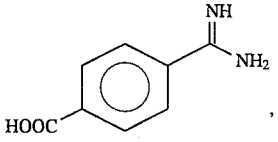

C-8

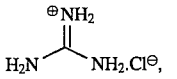

C-9

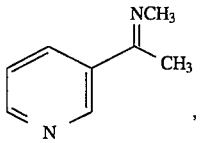

C-10

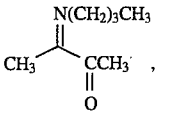

C-11

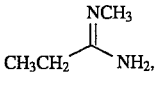

C-14

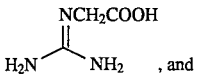

C-15

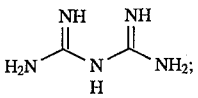

C-16 compounds of formula (D) are represented by the following:

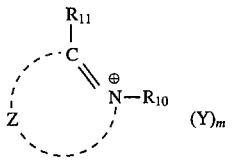

(D)

wherein $R_{10}$ represents an alkyl group, an alkenyl group, an aralkyl group, a cycloalkyl group, an aryl group, a heterocyclic group or a hydrogen atom, $R_{11}$ represents an alkyl group, an alkenyl group, an aralkyl group, a cycloalkyl group, an aryl group, a heterocyclic group, a hydrogen atom, a halogen group, an ether group, a carboxyl group, an acyl group, a cyano group, a sulfo group, a carbamoyl group, a nitro group, a dialkylamino group or an ester group, Z is selected from the group consisting of an imidazolium ring, a benzimidazolium ring, and a quinolinium ring, Y represents an anion, m represents 0 or 1, and $R_{10}$ can be bonded to an atom in Z to form a ring; and wherein the thiosulfate is added to the bleach-fixer in an amount of from 0.1 to 2 mol/l, the at least one compound represented by formula (I) is added to the bleach-fixer in an amount of from 0.1 to 20 g/l, the at least one type of compound selected from among the group of compounds represented by formulae (A), (B), (C) or (D) is added to the bleach-fixer in an amount of from 0.01 to 1.0 mol/l and the amount of the bleaching agent added to the bleach-fixer is 0.05 to 1.0 mol/l.

2. A method for processing a silver halide color photographic material as in claim 1, wherein the total processing time from the bleach-fix process to the final bath process is not more than 3 minutes.

3. A method for processing a silver halide color photographic material as in claim 1, wherein the color developer used in the color developing step is essentially free of benzyl alcohol.

4. A method for processing a silver halide color photographic material as in claim 1, wherein the compounds represented by formula (I) are represented by formula (I-a):

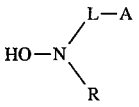

(I-a)

wherein L represents an alkylene group which may be substituted, A represents a carboxyl group, a sulfo group, a phosphono group, phosphinic acid residual group, a hydroxyl group, an amino group which may be substituted with alkyl groups, an ammonio group which may be substituted with alkyl groups, a carbamoyl group which may be substituted with alkyl groups, a sulfamoyl group which may be substituted with alkyl groups or an alkylsulfonyl group which may be substituted, and R represents a hydrogen atom or an alkyl group which may be substituted.

5. A method for processing a silver halide color photographic material as in claim 1, wherein said bleach-fixer contains an adduct of bisulfite with a compound represented by the formula (A).

6. A method for processing a silver halide color photographic material as in claim 1, wherein said bleach-fixer contains an adduct of bisulfite with a compound represented by the formula (B).

7. A method for processing a silver halide color photographic material as in claim 1, wherein said bleach-fixer contains an adduct of bisulfite with a compound represented by the formula (C).

8. A method for processing a silver halide color photographic material as in claim 1, wherein said bleach-fixer contains an adduct of bisulfite with a compound represented by the formula (D).

9. A method for processing a silver halide color photographic material as in claim 1, wherein said bleach-fixer further contains a sulfite or bisulfite in an amount of from 0.5 to 2 mol equivalent with respect to the at least one type of compound selected from among the group of compounds represented by formulae (A), (B), (C) and (D).

10. A method for processing a silver halide color photographic material as in claim 1, wherein a sulfite ion concentration in said bleach-fixer is maintained.

11. A method for processing a silver halide color photographic material as in claim 1, wherein the pH range of said bleach-fixer is from 5 to 6.5.

12. A method for processing a silver halide color photographic material as in claim 1, wherein said bleach-fixer does not substantially contain benzyl alcohol.

* * * * *